US009520085B2

(12) United States Patent
Ko et al.

(10) Patent No.: US 9,520,085 B2
(45) Date of Patent: Dec. 13, 2016

(54) ORGANIC LIGHT-EMITTING DIODE (OLED) DISPLAY

(71) Applicant: Samsung Display Co., Ltd., Yongin-si, Gyeonggi-do (KR)

(72) Inventors: Min Ho Ko, Cheonan-si (KR); Jae Won Choi, Hwaseong-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 258 days.

(21) Appl. No.: 14/220,344

(22) Filed: Mar. 20, 2014

(65) Prior Publication Data

US 2015/0015468 A1 Jan. 15, 2015

(30) Foreign Application Priority Data

Jul. 9, 2013 (KR) ..... 10-2013-0080552

(51) Int. Cl.
*G09G 3/3233* (2016.01)
*G09G 3/32* (2016.01)

(52) U.S. Cl.
CPC ..... *G09G 3/3233* (2013.01); *G09G 3/32* (2013.01); *G09G 3/3216* (2013.01); *G09G 2300/0452* (2013.01); *G09G 2300/0804* (2013.01); *G09G 2300/0814* (2013.01); *G09G 2300/0819* (2013.01); *G09G 2300/0842* (2013.01); *G09G 2300/0861* (2013.01); *G09G 2310/0262* (2013.01)

(58) Field of Classification Search
CPC ..... G09G 3/3233; G09G 3/3216; G09G 3/32
USPC ..... 345/82
See application file for complete search history.

(56) References Cited

U.S. PATENT DOCUMENTS 8,159,508 B2 * 4/2012 Lee ..... H01L 27/3211 313/582
8,610,347 B2 * 12/2013 Song ..... H01L 27/3213 313/504
2006/0210012 A1 * 9/2006 Yamaguchi ..... G11C 19/00 377/64
2007/0001937 A1 * 1/2007 Park ..... G09G 3/3233 345/76
2007/0057877 A1 * 3/2007 Choi ..... G09G 3/3233 345/76

(Continued)

FOREIGN PATENT DOCUMENTS

KR 10-2004-0039870 A 5/2004
KR 10-2005-0035550 A 4/2005

(Continued)

*Primary Examiner* — Fred Tzeng
(74) *Attorney, Agent, or Firm* — Knobbe, Martens, Olson & Bear, LLP

(57) ABSTRACT

An organic light-emitting diode (OLED) display is disclosed. In one aspect, the OLED display includes a substrate and odd and even-numbered pixels adjacent to each other in a column direction and respectively formed in odd and even-numbered rows. The OLED display also includes a common pixel driver connected to the odd and even-numbered pixels and driving each of the odd and even-numbered pixels. The OLED display further includes a selection unit selecting one of the odd and even-numbered pixels to be driven by the common pixel driver. The common pixel driver is formed in either the odd-numbered row or the even-numbered row.

20 Claims, 16 Drawing Sheets

(56) References Cited

U.S. PATENT DOCUMENTS

| | | | | |
|---|---|---|---|---|
| 2007/0115244 | A1* | 5/2007 | Shin | G09G 3/3266 345/100 |
| 2008/0150846 | A1* | 6/2008 | Chung | G09G 3/3233 345/80 |
| 2009/0295782 | A1* | 12/2009 | Lee | G09G 3/2022 345/213 |
| 2012/0113154 | A1* | 5/2012 | Ge | G09G 3/3614 345/690 |
| 2013/0147774 | A1* | 6/2013 | Yu | G09G 3/3648 345/204 |
| 2014/0009456 | A1* | 1/2014 | Kim | G09G 3/3208 345/212 |
| 2014/0184583 | A1* | 7/2014 | Wyatt | G09G 3/3614 345/214 |

FOREIGN PATENT DOCUMENTS

| | | | |
|---|---|---|---|
| KR | 10-2006-0023831 | A | 3/2006 |
| KR | 10-0599657 | B1 | 7/2006 |
| KR | 10-0600346 | B1 | 7/2006 |
| KR | 10-2007-0113673 | A | 11/2007 |
| KR | 10-2007-0116955 | A | 12/2007 |

* cited by examiner

ORGANIC LIGHT-EMITTING DIODE (OLED) DISPLAY

CROSS-REFERENCE TO RELATED APPLICATIONS

This application claims priority to and the benefit of Korean Patent Application No. 10-2013-0080552 filed in the Korean Intellectual Property Office on Jul. 9, 2013, the entire contents of which are incorporated herein by reference.

BACKGROUND

Field

The described technology generally relates to an organic light-emitting diode (OLED) display.

Description of the Related Technology

Display devices include a plurality of pixels arranged in a matrix in the display area of a substrate. Scan lines and data lines are connected to the pixels and data signals are selectively applied to the pixels to display an image.

Display devices can be categorized into passive and active matrix displays based on their driving structure. Active matrix displays are driven by selectively activating unit pixels and displays employing this technology are becoming mainstream due to the favorable resolution, contrast, and refresh rates of these devices.

Active matrix display devices can be used in mobile terminals such as personal computers, mobile phones, personal digital assistants (PDA), or the like, or as a monitor connected to an information device. The active matrix driving format can be used in various display devices, such as liquid crystal displays (LCDs), organic light-emitting diode (OLED) displays, plasma display panels (PDPs), or the like. OLED displays are gaining popularity due to their favorable characteristics such as excellent luminous efficiency, high luminance, and wide viewing angles in addition to fast response speeds.

SUMMARY OF CERTAIN INVENTIVE ASPECTS

One inventive aspect is a time-division control organic light-emitting diode (OLED) display.

Another aspect is an organic light-emitting diode (OLED) display having a layout margin in a common pixel driver by forming a common pixel driver shared by an odd-numbered pixel and an even-numbered pixel adjacent to each other in a column direction in one of an odd-numbered row or an even-numbered row.

Another aspect is an OLED display including a substrate, an odd-numbered pixel and an even-numbered pixel disposed to be adjacent in a column direction on the substrate and respectively formed at an odd-numbered row and an even-numbered row, a common pixel driver commonly connected to the odd-numbered pixel and the even-numbered pixel and driving the odd-numbered pixel and the even-numbered pixel, and a selection unit selecting and driving one of the odd-numbered pixel and the even-numbered pixel, wherein the common pixel driver is disposed in a row direction at one of the odd-numbered row or the even-numbered row.

The OLED display can include a scan line and a previous scan line respectively transmitting a scan signal and a previous scan signal, a data line and a driving voltage line crossing the scan line and the previous scan line and respectively transmitting a data signal and a driving voltage, a first light emission control line and a second light emission control line respectively transmitting a first light emission control signal and a second light emission control signal, and a first OLED and a second OLED positioned at the odd-numbered pixel and the even-numbered pixel and selected by the selection unit to be emitted, and the selection unit may drive one of the odd-numbered pixel and the even-numbered pixel according to the first light emission control signal and the second light emission control signal.

The common pixel driver may include a switching transistor connected to the scan line and the data line, a driving transistor connected to a switching drain electrode of the switching transistor, and a compensation transistor compensating a threshold voltage of the driving transistor and connected to the driving transistor.

The selection unit may include an odd-numbered operation control transistor and an even-numbered operation control transistor respectively turned on according to the first light emission control signal and the second light emission control signal to transmit the driving voltage to the driving transistor, and an odd-numbered light emission control transistor and an even-numbered light emission control transistor respectively turned on according to the first light emission control signal and the second light emission control signal to transmit the driving voltage to the first OLED and the second OLED in the driving transistor.

The odd-numbered light emission control transistor may be positioned between the driving drain electrode of the driving transistor and the first OLED, and the even-numbered light emission control transistor is positioned between the driving drain electrode and the second OLED.

The odd-numbered operation control transistor and the even-numbered operation control transistor may be positioned between the driving voltage line and the driving source electrode of the driving transistor.

The common pixel driver may further include an initialization transistor turned on according to a previous scan signal and transmitting the initialization voltage transmitted through the initialization voltage line to the driving gate electrode of the driving transistor and the initialization transistor is positioned between the initialization voltage line and the driving gate electrode of the driving transistor.

A third light emission control line transmitting a third light emission control signal may be further included and the selection unit may include an operation control transistor turned on by the third light emission control signal to transmit the driving voltage to the driving transistor and an odd-numbered light emission control transistor and an even-numbered light emission control transistor respectively turned on by the first light emission control signal and the second light emission control signal to transmit the driving voltage from the driving transistor to the first OLED and the OLED.

The odd-numbered light emission control transistor may be positioned between the driving drain electrode of the driving transistor and the first OLED, and the even-numbered light emission control transistor may be positioned between the driving drain electrode and the second OLED.

The operation control transistor may be positioned between the driving voltage line and the driving source electrode of the driving transistor.

The common pixel driver may further include an initialization transistor turned on according to the previous scan signal to transmit the initialization voltage transmitted through the initialization voltage line to the driving gate electrode of the driving transistor and the initialization transistor is positioned between the initialization voltage line and the driving gate electrode of the driving transistor.

Another aspect is an OLED display including a pixel dot having a first color pixel including a first color odd-numbered pixel and a first color even-numbered pixel disposed to be adjacent in a column direction and respectively formed at an odd-numbered row and an even-numbered row, a second color pixel including a second color odd-numbered pixel and a second color even-numbered pixel, and a third color pixel including a third color odd-numbered pixel and a third color even-numbered pixel, wherein the first color odd-numbered pixel, the second color odd-numbered pixel, and the third color odd-numbered pixel are disposed at the same odd-numbered row, the first color even-numbered pixel, the second color even-numbered pixel, and the third color even-numbered pixel are disposed at the same even-numbered row, and the common pixel driver driving one color pixel among the first color pixel to the third color pixel is formed throughout a position corresponding to the color pixel and an adjacent color pixel adjacent to the color pixel in a row direction.

A first color common pixel driver driving the first color odd-numbered pixel and the first color even-numbered pixel may be formed throughout a position corresponding to the first color even-numbered pixel and an adjacent color pixel adjacent to the first color even-numbered pixel in the row direction.

A second color common pixel driver driving the second color odd-numbered pixel and the second color even-numbered pixel may be formed throughout a position corresponding to the second color odd-numbered pixel and the adjacent color pixel adjacent to the second color odd-numbered pixel in the row direction.

A third color common pixel driver driving the third color odd-numbered pixel and the third color even-numbered pixel may be formed throughout a position corresponding to the third color odd-numbered pixel and the adjacent color pixel adjacent to the third color odd-numbered pixel in the row direction.

Another aspect is an OLED display including a substrate, a first pixel unit including a first odd-numbered pixel and a first even-numbered pixel respectively formed at the first odd-numbered row and the first even-numbered row on the substrate, a first common pixel driver commonly connected to the first odd-numbered pixel and the first even-numbered pixel and driving the first odd-numbered pixel and the first even-numbered pixel, and a first selection unit driving one of the first odd-numbered pixel and the first even-numbered pixel, a second pixel unit including a second odd-numbered pixel and a second even-numbered pixel disposed to be adjacent to the first pixel unit in the column direction and respectively formed at the second odd-numbered row and the second even-numbered row, a second common pixel driver commonly connected to the second odd-numbered pixel and the second even-numbered pixel and driving the second odd-numbered pixel and the second even-numbered pixel, and a second selection unit driving one of the second odd-numbered pixel and the second even-numbered pixel, and a common initialization voltage line disposed between the first pixel unit and the second pixel unit and commonly connected to the first pixel unit and the second pixel unit to transmit an initialization voltage, wherein the first common pixel driver is disposed at one of the first odd-numbered row or the first even-numbered row in the row direction, and the second common pixel driver is disposed at one of the second odd-numbered row or the second even-numbered row in the row direction. Another aspect is an organic light-emitting diode (OLED) display, comprising: a substrate; a plurality of pixels formed over the substrate and arranged in rows and columns, wherein the pixels comprise a plurality of odd-numbered pixels and a plurality of even-numbered pixel formed to be adjacent to each other in a column direction and wherein the odd-numbered pixels are formed in odd-numbered rows and the even-numbered pixels are formed in even-numbered rows; a common pixel driver connected to an odd-numbered pixel and an even-numbered pixel, wherein the common pixel driver is configured to alternately drive the odd-numbered pixel and the even-numbered pixel; and a selector configured to select one of the odd-numbered pixel and the even-numbered pixel to be driven by the common pixel driver, wherein the common pixel driver is formed in either the odd-numbered row or the even-numbered row.

The above display further comprises: a scan line and a previous scan line respectively configured to apply a scan signal and a previous scan signal; a data line and a driving voltage line crossing each of the scan line and the previous scan line, wherein the data line and the driving voltage line are respectively configured to apply a data signal and a driving voltage; a first light emission control line and a second light emission control line respectively configured to apply a first light emission control signal and a second light emission control signal; and a first OLED and a second OLED respectively formed in the odd-numbered pixels and the even-numbered pixels, wherein the selector is configured to control one of the odd-numbered pixel and the even-numbered pixel to be driven by the common pixel driver based at least in part on one of the first light emission control signal or the second light emission control signal.

In the above display, the common pixel driver comprises: a switching transistor connected to the scan line and the data line, wherein the switching transistor comprises a switching drain electrode; a driving transistor connected to the switching drain electrode; and a compensation transistor connected to the driving transistor and configured to compensate for a threshold voltage of the driving transistor. In the above display, the selector comprises: an odd-numbered operation control transistor and an even-numbered operation control transistor respectively configured to apply the driving voltage to the driving transistor based at least in part on the first and second light emission control signals, respectively; and an odd-numbered light emission control transistor and an even-numbered light emission control transistor respectively configured to selectively apply the driving voltage to the first and second OLEDs based at least in part on the first and second light emission control signals, respectively.

In the above display, the odd-numbered light emission control transistor is formed between and electrically connected to the driving transistor and the first OLED and wherein the even-numbered light emission control transistor is formed between and electrically connected to the driving transistor and the second OLED. In the above display, each of the odd-numbered operation control transistor and the even-numbered operation control transistor is formed between and electrically connected to the driving voltage line and the driving transistor.

The above display further comprises an initialization voltage line configured to apply an initialization voltage, wherein the common pixel driver further comprises an initialization transistor configured to apply the initialization voltage to the driving transistor based at least in part on the previous scan signal, wherein the initialization transistor is formed between and electrically connected to the initialization voltage line and the driving transistor. The above display further comprises a third light emission control line configured to apply a third light emission control signal, wherein the selector comprises: an operation control transistor configured to apply the driving voltage to the driving transistor based at least in part on the third light emission control signal; and an odd-numbered light emission control transistor and an even-numbered light emission control transistor respectively configured to apply the driving voltage to the first and second OLEDs based at least in part on the first and second light emission control signals, respectively.

In the above display, the odd-numbered light emission control transistor is formed between and electrically connected to the driving transistor and the first OLED and wherein the even-numbered light emission control transistor is formed between and electrically connected to the driving transistor and the second OLED. In the above display, the operation control transistor is formed between and electrically connected to the driving voltage line and the driving transistor. The above display further comprises an initialization voltage line configured to apply an initialization voltage, wherein the common pixel driver further comprises an initialization transistor configured to apply the initialization voltage to the driving transistor based at least in part on the previous scan signal, wherein the initialization transistor is formed between the initialization voltage line and the driving transistor.

Another aspect is an organic light-emitting diode (OLED) display, comprising: a plurality of pixel dots arranged in rows and columns; and a common pixel driver, wherein each pixel dot comprises: a first color pixel including i) a first color odd-numbered pixel and ii) a first color even-numbered pixel formed to be adjacent to each other in a column direction; a second color pixel including a second color odd-numbered pixel and a second color even-numbered pixel; and a third color pixel including a third color odd-numbered pixel and a third color even-numbered pixel, wherein each of the odd-numbered pixels is formed in an odd-numbered row and each of the even-numbered pixels is formed in an even-numbered row, wherein the common pixel driver is configured to drive the odd and even-numbered pixels of one of the first to third color pixels, and wherein the common pixel driver is formed adjacent to the one of the color pixels and a color pixel neighboring the one of the color pixels.

In the above display, the common pixel driver further comprises a first color common pixel driver, wherein the first color common pixel driver is configured to drive the odd and even-numbered pixels of the first color pixel, and wherein the first color common pixel driver is formed adjacent to the first color even-numbered pixel and ii) a position corresponding to a color pixel neighboring the first color even-numbered pixel. In the above display, the common pixel driver further comprises a second color common pixel driver, wherein the second color common pixel driver is configured to drive the odd and even-numbered pixels of the second color pixel, and wherein the second color common pixel driver is formed adjacent to the second color odd-numbered pixel and a color pixel neighboring the second color odd-numbered pixel.

In the above display, the common pixel driver further comprises a third color common pixel driver, wherein the third color common pixel driver is configured to drive the odd and even-numbered pixels of the third color pixel, and wherein the third color common pixel driver is formed adjacent to the third color odd-numbered pixel and a color pixel neighboring the third color odd-numbered pixel.

Another aspect is an organic light-emitting diode (OLED) display, comprising: a substrate; a plurality of pixels formed over the substrate and arranged in rows and columns, wherein the pixels comprise: a first pixel unit including a first odd-numbered pixel and a first even-numbered pixel respectively formed in a first odd-numbered row and a first even-numbered row; and a second pixel unit including a second odd-numbered pixel and a second even-numbered pixel respectively formed in a second odd-numbered row and a second even-numbered row; a first common pixel driver electrically connected to the first odd-numbered pixel and the first even-numbered pixel, wherein the first common pixel driver is configured to drive the first odd-numbered pixel and the first even-numbered pixel, and a first selector configured to select one of the first odd-numbered pixel and the first even-numbered pixel to be driven by the first common pixel driver; a second common pixel driver electrically connected to the second odd-numbered pixel and the second even-numbered pixel, wherein the second common pixel driver is configured to drive the second odd-numbered pixel and the second even-numbered pixel; and a second selector configured to select one of the second odd-numbered pixel and the second even-numbered pixel to be driven by the second common pixel driver; and a common initialization voltage line formed between the first and second pixel units and respectively electrically connected to the first and second pixel units, wherein the common initialization voltage line is configured to apply an initialization voltage to the first and second pixel units, wherein the first common pixel driver is formed in one of the first odd and even-numbered rows, and wherein the second common pixel driver is formed in one of the second odd and even-numbered rows.

Another aspect is an organic light-emitting diode (OLED) display, comprising: a plurality of pixels arranged in rows and columns, wherein the pixels comprise: a plurality of first pixels formed in odd-numbered rows; and a plurality of second pixels formed in even-numbered row and adjacent to the first pixels in a column direction; and a common pixel driver connected to the first and second pixels, wherein the common pixel driver is configured to alternately drive the first and second pixels, wherein the common pixel driver is formed in a position substantially directly below one of the first and second pixels.

The above display further comprises a selector configured to select one of the first and second pixels to be driven by the common pixel driver. The above display further comprises first and second light emission control lines respectively configured to apply first and second light emission control signals, wherein the selector is further configured to control one of the first and second pixels to be driven by the common pixel driver based at least in part on one of the first and second light emission control signals. In the above display, the common pixel driver is formed in one of the odd and even-numbered rows.

According to at least one embodiment, by disposing the common pixel driver shared with the odd-numbered pixel and the even-numbered pixel adjacent in the column direction at one of the odd-numbered row or the even-numbered row in the row direction, the common pixel driver can be formed to be comparatively wide.

Accordingly, a sufficient line width of the data line and driving voltage line may be ensured in order to substantially prevent color deviation generated between the odd-numbered pixel and the even-numbered pixel and deterioration of the long range uniformity of the displayed image.

Also, the common pixel driver in the row direction may be formed with a sufficient width such that the channel length of the driving transistor formed in the row direction may be comparatively elongated to increase the driving range, thereby preventing spots from occurring in the displayed image.

In addition, by driving the odd-numbered pixel and the even-numbered pixel adjacent in the column direction by using one operation control transistor, a layout margin in the row direction may be obtained, thereby realizing high resolution.

Further, by forming the common initialization voltage line which commonly applies the initialization voltage to the first pixel unit and the second pixel unit disposed adjacent to each other in the column direction, a layout margin in the column direction may also be obtained.

DETAILED DESCRIPTION OF CERTAIN INVENTIVE EMBODIMENTS

Figure 1:
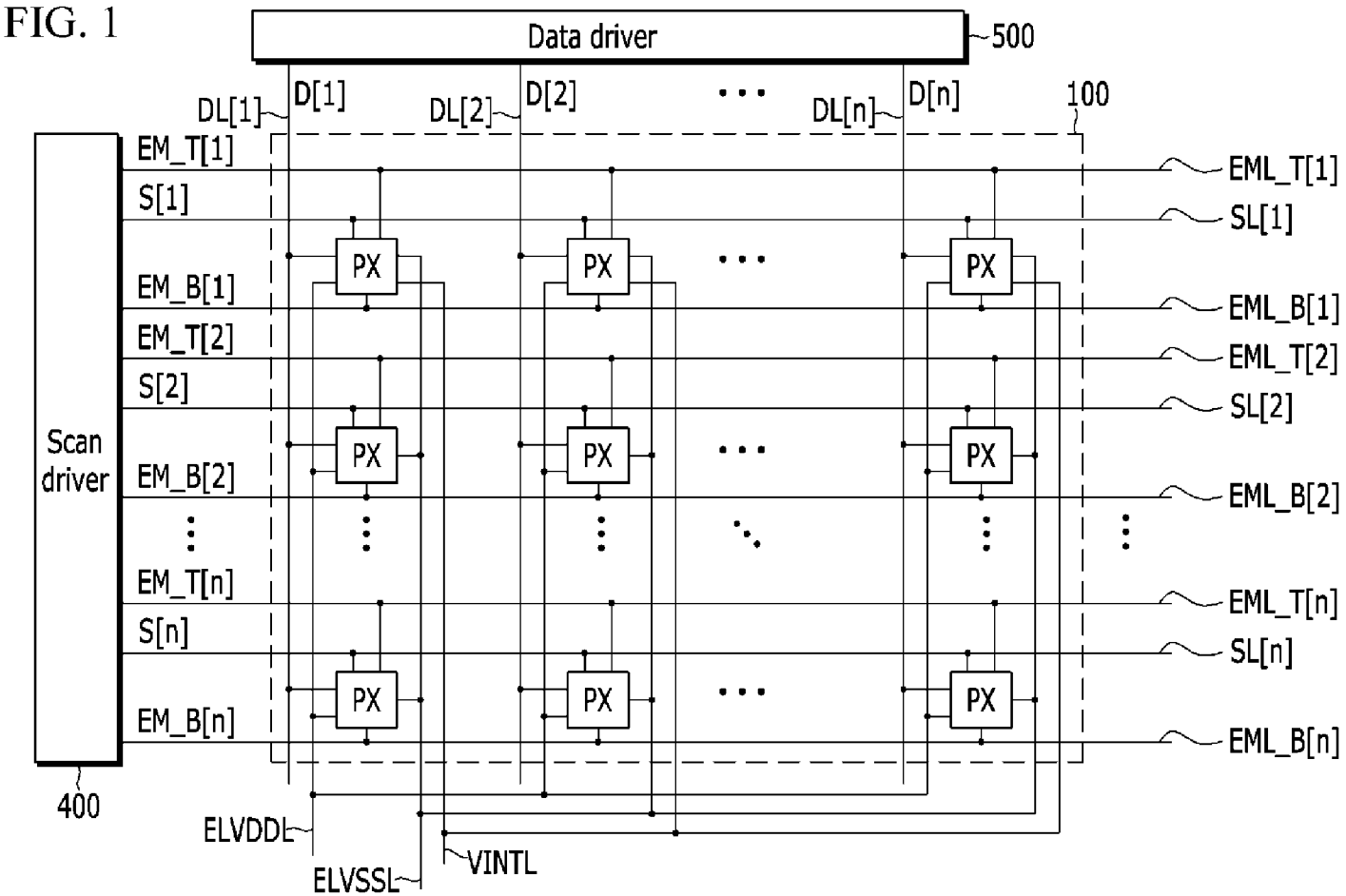
FIG. 1 is a circuit diagram of an OLED display according to an exemplary embodiment.

OLED displays can be driven using a time-division control method which includes supplying a driving current to a plurality of OLEDs through a single driving transistor. In this method, one frame is time-divided into a plurality of fields and displayed by sequentially emitting light from a plurality of OLEDs.

For example, an upper OLED and a lower OLED can be respectively positioned over and below a common pixel driver having one driving transistor. The upper and lower OLEDs emit light in response to receiving a driving voltage from the common pixel driver. One frame is divided into two subfields including an odd field and an even field and an odd-numbered pixel including the upper OLED located in an odd-numbered row can emit light for the odd field. An even-numbered pixel including the lower OLED positioned in an even-numbered row can emit light for the even field. As described above, the odd and even-numbered pixels share a single common pixel driver such that the number of transistors per pixel is reduced while maintaining a high resolution.

However, the common pixel driver shared by the odd and even-numbered pixels that are adjacent in the column direction is typically located between the pixels. In this configuration, the common pixel driver is longer in the column direction than in the row direction. Thus, there is a limitation to increasing the resolution of the display due to the widths of the data line and the driving voltage line extending in the column direction and being connected to the common pixel driver. Accordingly, displayed colors can deviate between the odd and even-numbered pixels and the long range uniformity (LRU) of the displayed image can degrade. Also, spots can be easily generated because of the limitation in channel length of the driving transistor.

The described technology will be described more fully hereinafter with reference to the accompanying drawings, in which exemplary embodiments are shown. As those skilled in the art would realize, the described embodiments may be modified in various different ways, all without departing from the spirit or scope of the described technology.

Descriptions of elements not related to the described technology are omitted, and like reference numerals designate like elements throughout the specification.

In addition, the size and thickness of each element shown in the drawings may be exaggerated for clarity and are not limited thereto.

In the drawings, the thickness of layers, films, panels, regions, etc., may be exaggerated for clarity. In the drawings, in order to facilitate understanding and for ease of description, the thicknesses of some layers and areas are exaggerated. It will be understood that when an element such as a layer, film, region, or substrate is referred to as being "on" another element, it can be directly on the other element or intervening elements may also be present.

In addition, unless explicitly described to the contrary, the word "comprise" and variations such as "comprises" or "comprising" will be understood to imply the inclusion of stated elements but not the exclusion of any other elements. Further, throughout the specification, the term "on" implies being positioned above or below a target element and does not imply being necessarily positioned on the top on the basis of the orientation of the device.

Now, an organic light-emitting diode (OLED) display according to an exemplary embodiment will be described with reference to FIG. 1 to FIG. 8.

FIG. 1 is a circuit diagram of an OLED display according to an exemplary embodiment.

As shown in FIG. 1, the OLED display includes a display unit or display panel 100, a scan driver 400, and a data driver 500. The display unit 100 is a display area including a plurality of pixels (PX), a plurality of scan lines SL[1]-SL[n], and a plurality of data lines DL[1]-DL[m]. The display unit 100 also includes a driving voltage line ELVDDL applying a driving voltage ELVDD, a common voltage line ELVSSL applying a common voltage ELVSS, an initialization voltage line VINTL applying an initialization voltage Vint, first light emission control lines EML_T[1]-EML_T[n], and second light emission control lines EML_B [1]-EML_B [n].

The scan driver 400 is connected to the scan lines SL[1]-SL[n], the first light emission control lines EML_T[1]-EML_T[n], and the second light emission control lines EML_B[1]-EML_B[n]. The scan driver 400 generates a plurality of scan signals S[1]-S[n], a plurality of first light emission control signals EM_T[1]-EM_T[n], and a plurality of second light emission control signals EM_B[1]-EM_B[n] based on a first driving control signal CONT1.

The scan driver 400 applies the scan signals S[1]-S[n] to the corresponding scan lines SL[1]-SL[n]. The scan driver 400 applies the first light emission control signals EM_T[1]-EM_T[n] to the corresponding first light emission control lines EML_T[1]-EML_T[n] and applies the second light emission control signals EM_B[1]-EM_B[n] to the corresponding second light emission control lines EML_B[1]-EML_B[n].

The data driver 500 samples and maintains image data R, G, and B based on the second driving control signal CONT2 to generate a plurality of data signals D[1]-D[m]. The data driver 500 applies the data signals D[1]-D[m] to the corresponding data lines DL[1]-DL[m].

Figure 2:
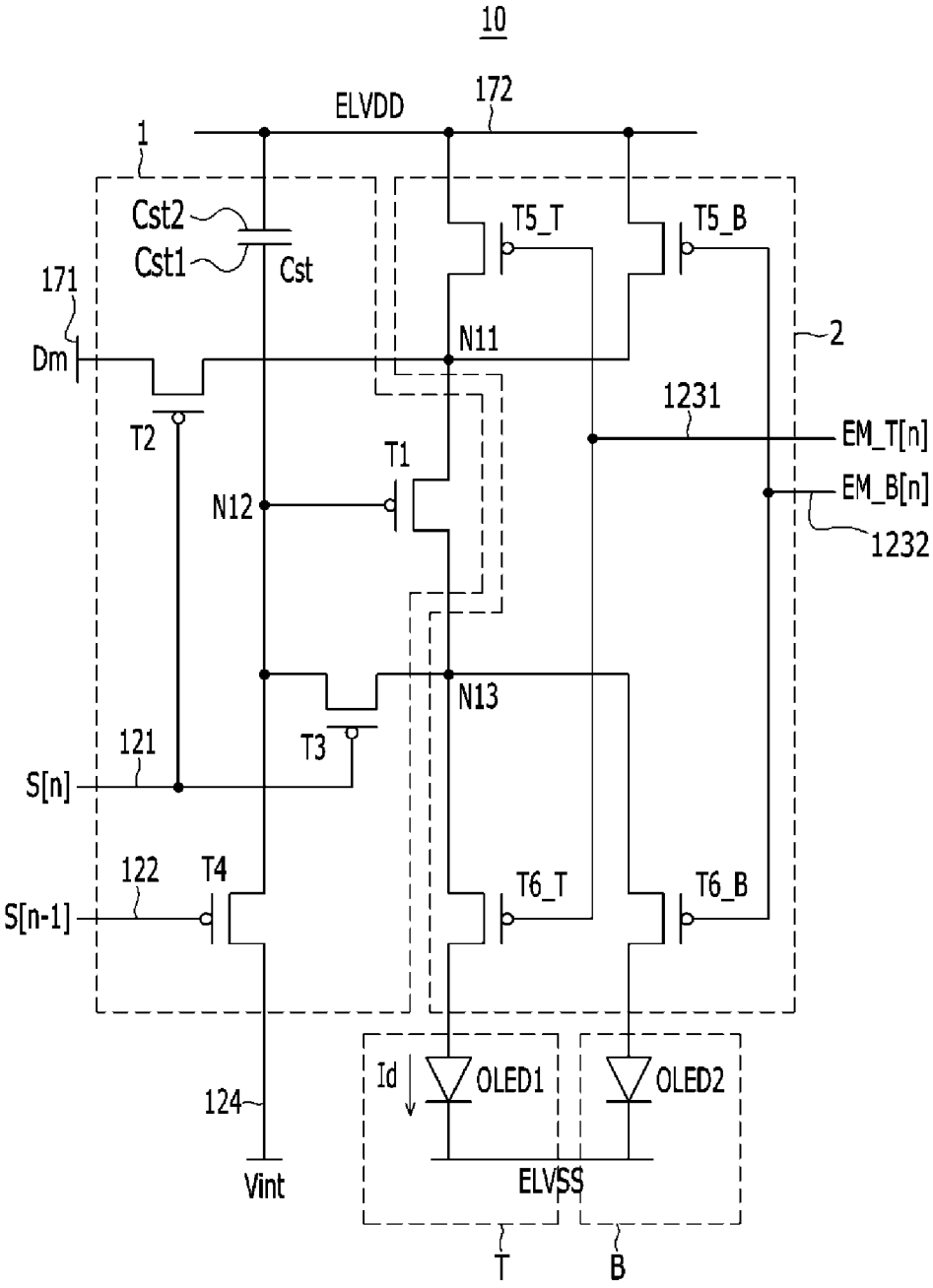
FIG. 2 is an equivalent circuit of a pixel unit of an OLED display according to an exemplary embodiment.

FIG. 2 is an equivalent circuit of a pixel unit according to an exemplary embodiment.

As shown in FIG. 2, the pixel unit 10 includes an odd-numbered pixel T, an even-numbered pixel B, a common pixel driver 1, and a selection unit or selector 2.

The odd-numbered pixel T is formed in an odd-numbered row and includes a first OLED OLED1 and the even-numbered pixel B is adjacent to the odd-numbered pixel T in the column direction and includes a second OLED OLED2.

The common pixel driver 1 is selected based on the (n−1)-th scan signal S[n−1] and the n-th scan signal S[n] and receives the data signal Dm from a data line 171. The common pixel driver 1 generates a driving current (Id) corresponding to the data signal Dm.

Here, the common pixel driver 1 includes a driving transistor T1, a switching transistor T2, a compensation transistor T3, an initialization transistor T4, and a storage capacitor Cst. The driving transistor T1 includes a source electrode connected to a first node N11, a gate electrode connected to the second node N12, and a drain electrode connected to the third node N13. The driving transistor T1 controls the driving current (Id) to flow the third node N13 according to the voltage applied to the gate electrode.

The switching transistor T2 includes a source electrode connected to the data line Dm, a drain electrode connected to the first node N11, and a gate electrode connected to the scan line 121. The switching transistor T2 is turned on based on the n-th scan signal S[n] to transmit the data signal Dm to the first node N11.

The compensation transistor T3 includes a drain electrode connected to the second node N12, a source electrode connected to the third node N13, and a gate electrode connected to the scan line 121. The compensation transistor T3 is turned on based on the n-th scan signal S[n] and diode-connects the drain and gate electrodes of the first transistor T1 to each other.

The initialization transistor T4 includes a drain electrode connected to the second node N12, a source electrode connected to an initialization voltage line 124, and a gate electrode connected to a previous scan line 122. The initialization transistor T4 is turned on based on the previous scan signal S[n−1] to transmit the initialization voltage Vint to the second node N12.

The storage capacitor Cst includes a first storage capacitive plate Cst1 connected to the second node N12 and a second storage capacitive plate Cst2 connected to a driving voltage line 172. The storage capacitor Cst stores a voltage corresponding to the data signal Data.

The selection unit 2 applies the driving current (Id) to one of the first OLED OLED1 and the second OLED OLED2 based on the first and second light emission control signals EM_T[n] and EM_B[n]. Thus, the first and second OLEDs, OLED1 and OLED2, are alternately driven based on the selection of the selection unit 2. The selection unit 2 includes an odd-numbered operation control transistor T5_T, an even-numbered operation control transistor T5_B, an odd-numbered light emission control transistor T6_T, and an even-numbered light emission control transistor T6_B.

The odd-numbered operation control transistor T5_T includes a source electrode connected to the driving voltage line 172, a drain electrode connected to the first node N11, and a gate electrode connected to the first light emission control line 1231. The even-numbered operation control transistor T5_B includes a source electrode connected to the driving voltage line 172, a drain electrode connected to the first node N11, and a gate electrode connected to a second light emission control line 1232.

The odd-numbered light emission control transistor T6_T includes a source electrode connected to the third node N13, a drain electrode connected to the anode of the first OLED OLED1, and a gate electrode connected to a first light emission control line 1231. The even-numbered light emission control transistor T6_B includes a source electrode connected to the third node N13, a drain electrode connected to the anode of the second OLED OLED2, and a gate electrode connected to the second light emission control line 1232.

The first and second OLEDs OLED1 and OLED2 each include an anode respectively connected to the drain electrodes of the odd and even-numbered light emission control transistors T6_T and T6_B. Each of the first and second OLEDs, OLED1 and OLED2, include a cathode connected to the common voltage line 173 which is applied with the common voltage ELVSS and an organic emission layer formed between the anode and the cathode. Here, the first and second OLEDs OLED1 and OLED2 emit the same color of light, for example, red, green, or blue light.

Figure 3:
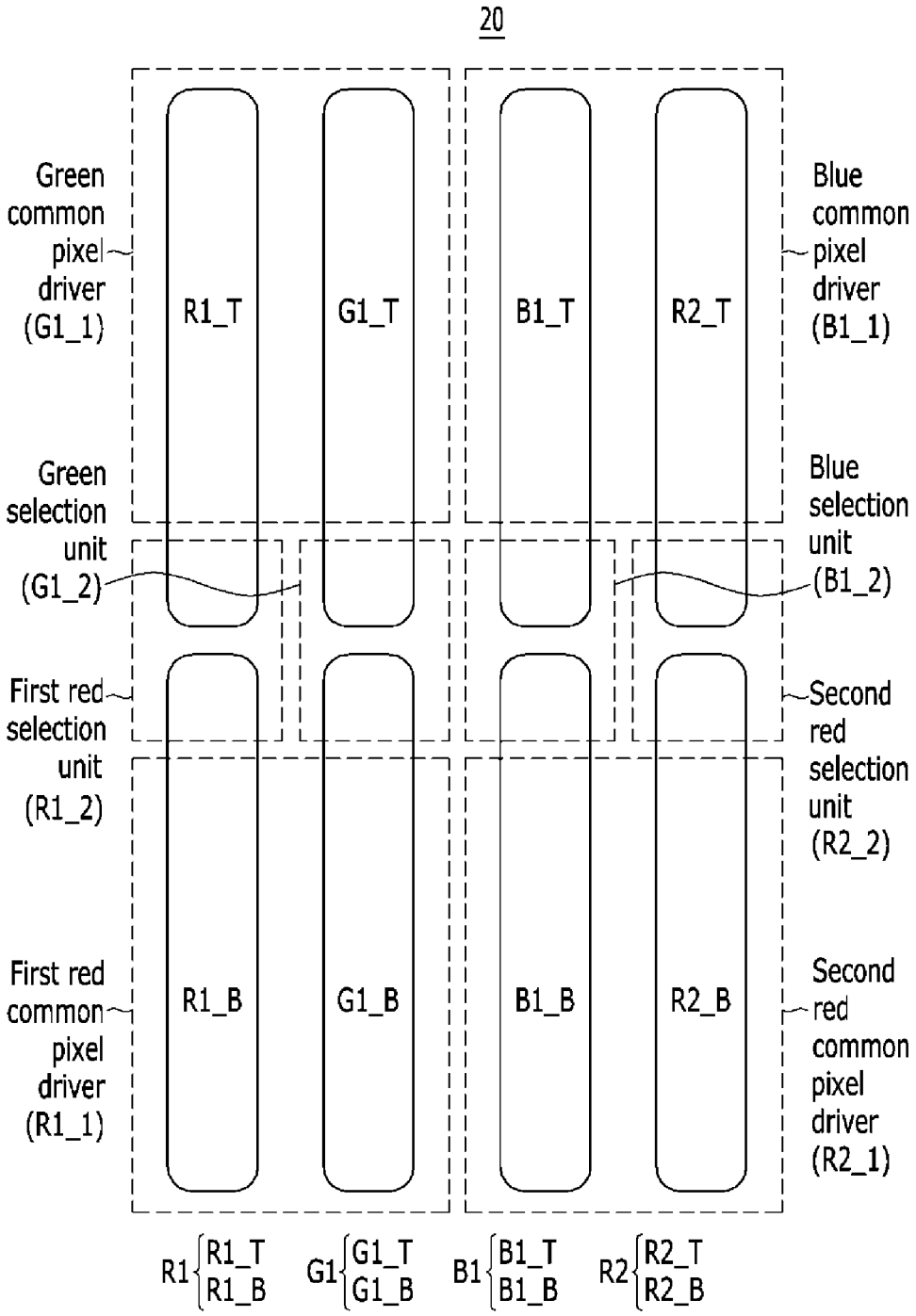
FIG. 3 is a schematic view of a pixel dot including four pixel units according to an exemplary embodiment.

An embodiment of the circuit diagram of FIG. 1 and FIG. 2 is the schematic structure illustrated in FIG. 3. This structure will be described with reference to FIG. 3.

FIG. 3 is a schematic view of a pixel dot including four pixel units according to an exemplary embodiment.

As shown in FIG. 3, an embodiment of the OLED display includes a pixel dot 20 including a first color pixel R1, a second color pixel G1, a third color pixel B1, and a fourth color pixel R2. Here, the first, second, third, and fourth colors may be red, green, blue and white, respectively.

The first red pixel R1 includes the first red odd-numbered pixel R1_T and the first red even-numbered pixel R1_B located adjacent to each other in the column direction and respectively formed in the odd and even-numbered rows. Similarly, the green pixel G1 includes the green odd and even-numbered pixels G1_T and G1_B located adjacent to each other in the column direction and respectively formed the odd and even-numbered rows. The blue pixel B1 includes the blue odd and even-numbered pixels B1_T and B1_T located adjacent to each other in the column direction and respectively formed in the odd and even-numbered rows. The second red pixel R2 includes the second red odd and even-numbered pixels R2_T and R2_T located adjacent to each other in the column direction and respectively formed at the odd and even-numbered rows.

The first red, green, blue, and second red odd-numbered pixels R1_T, G1_T, B1_T, and R2_T are formed in the same odd-numbered row. Likewise, the first red, green, blue, and second red even-numbered pixels R1_B, G1_B, B1_B, and R2_B are formed in the same even-numbered row.

The first red common pixel driver R1_1 drives the first red odd and even-numbered pixels R1_T and R1_B and is formed in a position corresponding to the first red and green even-numbered pixels R1_B and G1_B. The green even-numbered pixel G1_B is adjacent to the first red even-numbered pixel R1_B in the row direction. Also, the green common pixel driver G1_1 drives the green odd and even-numbered pixels G1_T and G1_B and is formed in a position corresponding to the green and first red odd-numbered pixels G1_T and R1_T. The first red odd-numbered pixel R1_T is adjacent to the green odd-numbered pixel G1_T in the row direction.

The first red selection unit R1_2 and the green selection unit G1_2 are formed between the first red and green common pixel drivers R1_1 and G1_1. The first red selection unit R1_2 drives one of the first red pixels R1_T and R1_B, and the green selection unit G1_2 drives one of the green pixels G1_T and G1_B.

The blue common pixel driver B1_1 drives the blue pixels B1_T and B1_B and is formed om a position corresponding to the blue odd-numbered pixel B1_T and the second red odd-numbered pixel R2_T. The second red odd-numbered pixel R2_T is adjacent to the blue odd-numbered pixel B1_T in the row direction. Also, the second red common pixel driver R2_1 drives the second red pixels R2_T and R2_B and is formed in a position corresponding to the blue even-numbered pixel B1_B and the second red even-numbered pixel R2_B. The blue even-numbered pixel B1_B is adjacent to the second red even-numbered pixel R2_B in the row direction.

The second red selection unit R2_2 and the blue selection unit B1_2 are formed between the second red common pixel driver R2_1 and the blue common pixel driver B1_1. The second red selection unit R2_2 drives one of the second red pixels R2_T and R2_B, and the blue selection unit B1_2 drives one of the blue pixels B1_T and B1_T.

The first red, green, blue, and second red common pixel drivers R1_1, G1_1, B1_1, and R2_1 are one embodiment of the common pixel driver 1 shown in FIG. 2. The first red, green, blue, and second red selection units R1_2, G1_2, B1_2, and R2_2 are one embodiment of the selection unit 2 shown in FIG. 2.

As described above, the common pixel drivers R1_1, G1_1, B1_1, and R2_1 shared by the odd and even-numbered pixels adjacent in the column direction are formed to be substantially as wide as the odd-numbered row and the even-numbered row such that a sufficient width can be easily ensured when manufacturing the OLED display.

A detailed structure of the schematic pixel dot shown in FIG. 3 will be described with reference to FIG. 4 to FIG. 7.

Figure 4:
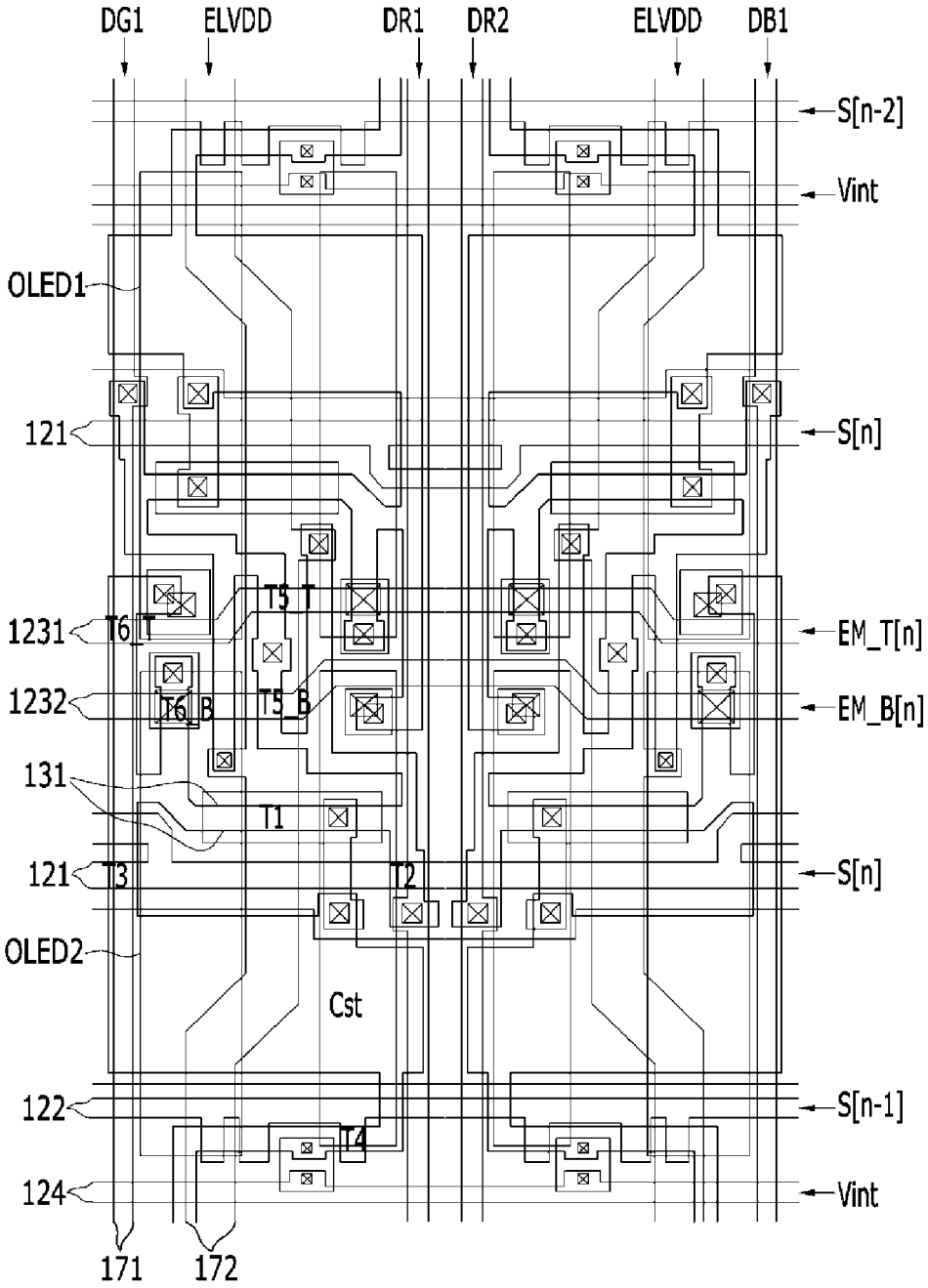
FIG. 4 is a schematic view of a plurality of transistors and capacitors formed in a pixel dot of an OLED display according to an exemplary embodiment.
Figure 5:
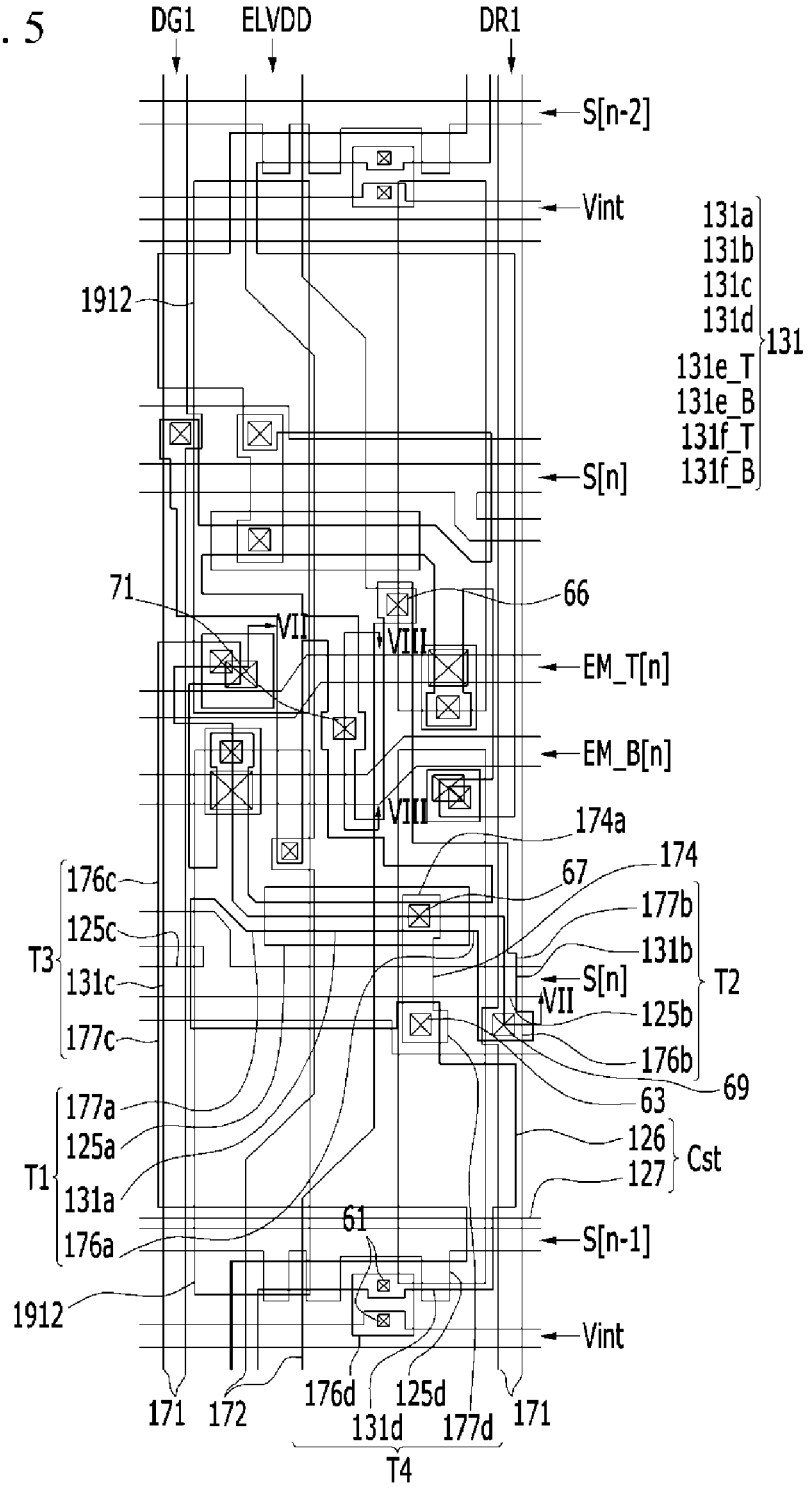
FIG. 5 is a layout view of a first red odd-numbered pixel, a first red even-numbered pixel, and a first red common pixel driver and a first red selection unit connected thereto, and a green odd-numbered pixel, a green even-numbered pixel, and a green common pixel driver and a green selection unit connected thereto of an OLED display according to an exemplary embodiment.
Figure 6:
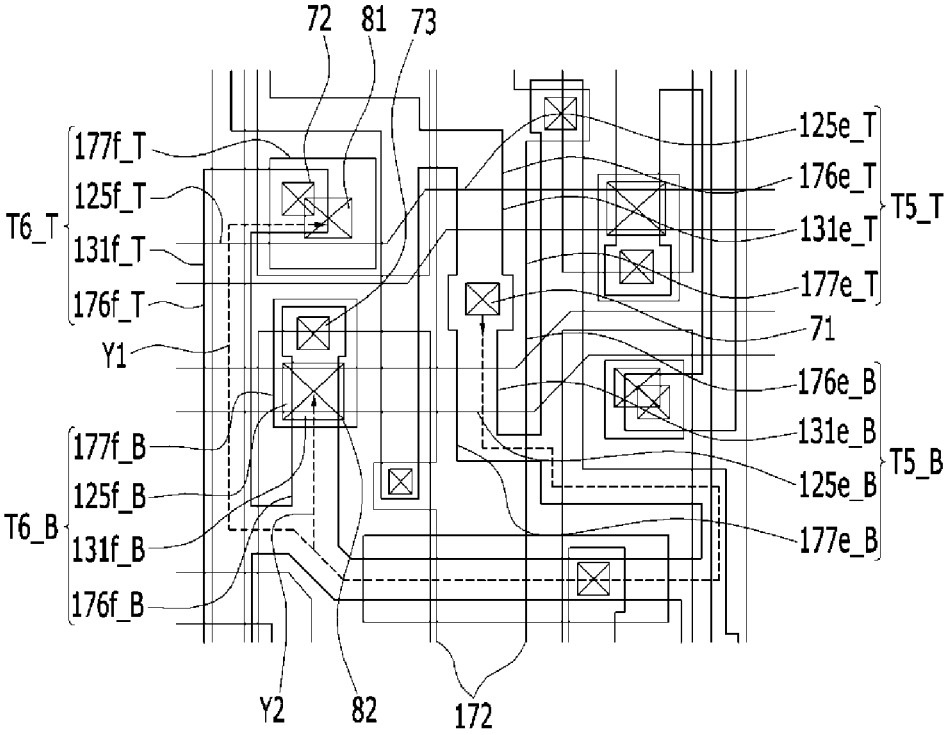
FIG. 6 is an enlarged layout view of the first red selection unit and the green selection unit shown in FIG. 5.
Figure 7:
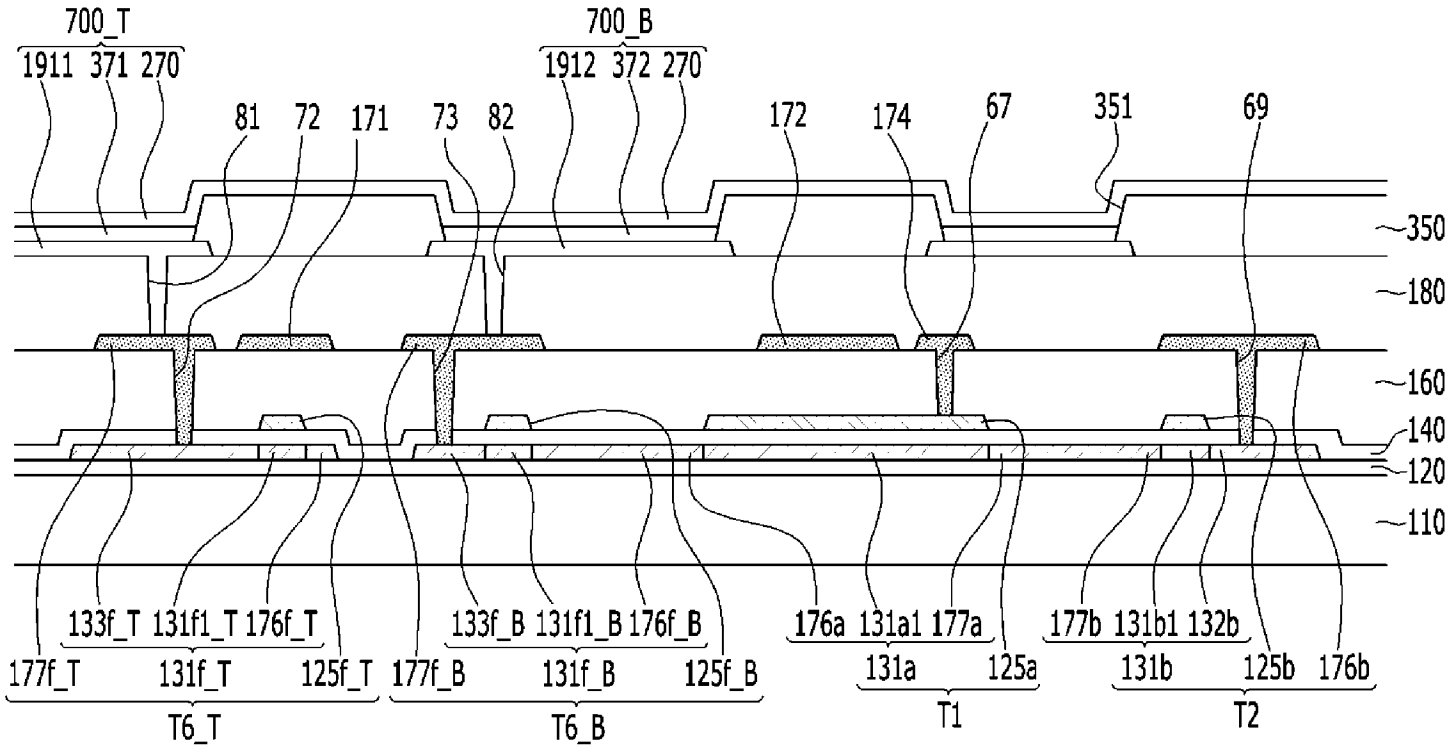
FIG. 7 is a cross-sectional view taken along the line VII-VII of FIG. 5.
Figure 8:
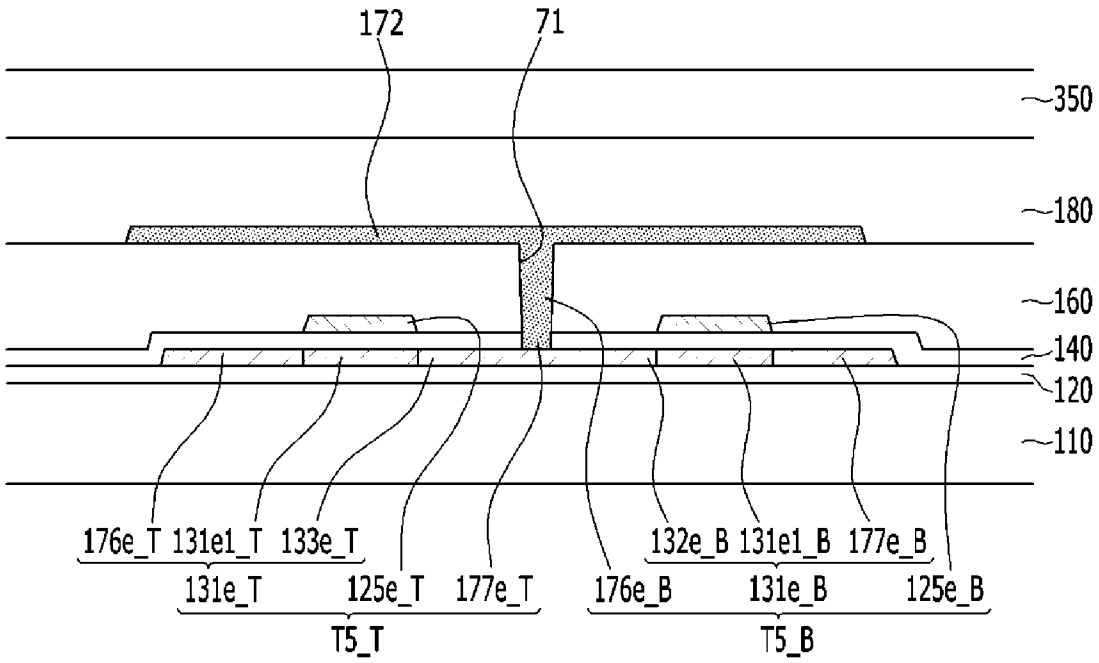
FIG. 8 is a cross-sectional view taken along the line VIII-VIII of FIG. 5.

FIG. 4 is a schematic view of a plurality of transistors and capacitors formed in a pixel dot of an OLED display according to an exemplary embodiment. FIG. 5 is a layout view of a first red odd-numbered pixel, a first red even-numbered pixel, a first red common pixel driver and a first red selection unit connected thereto, a green odd-numbered pixel, a green even-numbered pixel, and a green common pixel driver and a green selection unit connected thereto included in an OLED display according to an exemplary embodiment. FIG. 6 is an enlarged layout view of the first red selection unit and the green selection unit shown in FIG. 5. FIG. 7 is a cross-sectional view taken along the line VII-VII of FIG. 5, and FIG. 8 is a cross-sectional view taken along the line VIII-VIII of FIG. 5.

Here, the first red odd-numbered pixel R1_T, the first red even-numbered pixel R1_B, and the first red common pixel driver R1_1 and the first red selection unit R1_2 connected thereto will be described.

Firstly, as shown in FIG. 4, the OLED display includes the scan line 121, the previous scan line 122, the first light emission control line 1231, the second light emission control line 1232, and the initialization voltage line 124 each formed in the row direction each configured to apply a corresponding signal to the pixel unit 10. The OLED display also includes the data line 171 and the driving voltage line 172 intersecting each of the scan line 121, the previous scan line 122, the first light emission control line 1231, the second light emission control line 1232, and the initialization voltage line 124 and configured to apply the data signals DR1, DG1, DB1, and DR2 and the driving voltage ELVDD to the pixel unit 10.

The pixel unit 10 also includes the driving transistor T1, the switching transistor T2, the compensation transistor T3, the initialization transistor T4, the odd-numbered operation control transistor T5_T, the even-numbered operation control transistor T5_B, the odd-numbered light emission control transistor T6_T, the even-numbered light emission control transistor T6_B, the storage capacitor Cst, the first organic light emitting diode OLED1, and the second organic light emitting diode OLED2.

Each of the transistors T1 to T4, T5_T, T5_B, T6_T, and T6_B are formed including a semiconductor layer 131 and the semiconductor layer 131 is formed to have various shapes. The semiconductor layer 131 may be formed of polysilicon or an oxide semiconductor. The oxide semiconductor may include any one of oxides including titanium (Ti), hafnium (Hf), zirconium (Zr), aluminum (Al), tantalum (Ta), germanium (Ge), zinc (Zn), gallium (Ga), tin (Sn), or indium (In) as a base, or complex oxides thereof, such as zinc oxide (ZnO), indium-gallium-zinc oxide (InGaZnO4), indium-zinc oxide (Zn—In—O), zinc-tin oxide (Zn—Sn—O) indium-gallium oxide (In—Ga—O), indium-tin oxide (In—Sn—O), indium-zirconium oxide (In—Zr—O), indium-zirconium-zinc oxide (In—Zr–Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), or hafnium-indium-zinc oxide (Hf—In—Zn—O). Where the semiconductor layer 131 is formed of an oxide semiconductor, a separate protective layer may be added to protect the oxide semiconductor which may be vulnerable to ambient environmental conditions such as high temperatures.

The semiconductor layer 131 includes a channel region that is subjected to channel doping with an N-type impurity or a P-type impurity and a source region and a drain region that are formed at respective sides of the channel region and formed by doping with the other of the N or P-type impurity used in doping the channel region.

Hereinafter, a planar structure of the OLED display according to an exemplary embodiment will be described in detail with reference to FIG. 4 to FIG. 6 and a lamination structure thereof will be described in detail with reference to FIG. 7 and FIG. 8.

First, as shown in FIG. 5, the semiconductor layer 131 of the OLED display includes a driving semiconductor layer 131*a* formed in the driving transistor T1, a switching semiconductor layer 131*b* formed in the switching transistor T2, a compensation semiconductor layer 131*c* formed in the compensation transistor T3, and an initialization semiconductor layer 131*d* formed in the initialization transistor T4. The semiconductor layer 131 also includes an odd-numbered operation control semiconductor layer 131*e*_T and an even-numbered operation control semiconductor layer 131*e*_B respectively formed in the odd and even-numbered operation control transistor T5_T and T5_B. The semiconductor layer 131 further includes an odd-numbered light emission control semiconductor layer 131*f*_T and an even-numbered light emission control semiconductor layer 131*f* B respectively formed in the odd and even-numbered light emission control transistors T6_T and T6_B.

The first red common pixel driver R1_1 includes the driving transistor T1, the switching transistor T2, the compensation transistor T3, and the initialization transistor T4. The first red selection unit R1_2 includes the odd and even-numbered operation control transistors T5_T and T5_B and the odd and even-numbered light emission control transistors T6_T and T6_B.

The driving transistor T1 includes the driving semiconductor layer 131*a*, a driving gate electrode 125*a*, a driving source electrode 176*a*, and a driving drain electrode 177*a*. The driving source electrode 176*a* is connected to a driving source region 176*a* which is doped with the impurity in the driving semiconductor layer 131*a*. The driving drain electrode 177*a* is connected to a driving drain region 177*a* which is doped with the impurity in the driving semiconductor layer 131*a*.

The driving gate electrode 125*a* is formed with the same material and in the same layer as the scan line 121, the previous scan line 122, a switching gate electrode 125*b*, a compensation gate electrode 125*c*, and an initialization gate electrode 125*d*.

The switching transistor T2 includes the switching semiconductor layer 131*b*, the switching gate electrode 125*b*, a switching source electrode 176*b*, and a switching drain electrode 177*b*. The switching source electrode 176*b* is formed as a portion of the data line 171 and the switching drain electrode 177*b* is connected to the switching drain region 177*b* which is doped with the impurity in the switching semiconductor layer 131*b*.

The compensation transistor T3 includes the compensation semiconductor layer 131*c*, the compensation gate electrode 125*c*, a compensation source electrode 176*c*, and a compensation drain electrode 177*c*. The compensation source electrode 176*c* is connected to the compensation source region 176*c* which is doped with the impurity in the compensation semiconductor layer 131*c* and the compensation drain electrode 177*c* is connected to the compensation drain region 177*c* which is doped with the impurity in the compensation semiconductor layer 131*c*.

The initialization transistor T4 includes the initialization semiconductor layer 131*d*, the initialization gate electrode 125*d*, an initialization source electrode 176*d*, and an initialization drain electrode 177*d*. The initialization source electrode 176*d* is connected to both the initialization voltage line 124 and the initialization semiconductor layer 131*d* through a contact hole 61. The initialization drain electrode 177*d* is formed as an end of a connection member 174 and is connected to the initialization semiconductor layer 131*d* through a contact hole 63.

The odd-numbered operation control transistor T5_T includes the odd-numbered operation control semiconductor layer 131*e*_T, an odd-numbered operation control gate electrode 125*e*_T, an odd-numbered operation control source electrode 176*e*_T, and an odd-numbered operation control drain electrode 177*e*_T. The even-numbered operation control transistor T5_B includes the even-numbered operation control semiconductor layer 131*e*_B, an even-numbered operation control gate electrode 125*e*_B, an even-numbered operation control source electrode 176*e*_B, and an even-numbered operation control drain electrode 177*e*_B.

The odd-numbered light emission control transistor T6_T includes the odd-numbered light emission control semiconductor layer 131*f* T, an odd-numbered light emission control gate electrode 125*f*_T, an odd-numbered light emission control source electrode 176*f* T, and an odd-numbered light emission control drain electrode 177*f* T. The even-numbered light emission control transistor T6_B includes the even-numbered light emission control semiconductor layer 131*f*_B, an even-numbered light emission control gate electrode 125*f* B, an even-numbered light emission control source electrode 176*f* B, and an even-numbered light emission control drain electrode 177*f* B.

The odd-numbered operation control transistor T5_T and the odd-numbered light emission control transistor T6_T are operated according to the first light emission control signal EM_T[n] to control a first OLED 700_T including a first pixel electrode 1911 to emit light. The even-numbered operation control transistor T5_B and the even-numbered light emission control transistor T6_B are operated according to the second light emission control signal EM_B[n] to control a second OLED 700_B including a second pixel electrode 1912 to emit light. Y1 shown in FIG. 6 represents a path through which current flows to control the first OLED 700_T to emit light based on the first light emission control signal EM_T[n] and Y2 represents a path through which current flows to control the second OLED 700_B to emit light based on the second light emission control signal EM_B [n].

As described above, the first red common pixel driver R1_1 shared by the first red odd and even-numbered pixels adjacent to each other in the column direction is formed to be substantially as wide as the even-numbered row such that a sufficient width can be easily ensured when manufacturing the OLED display.

Accordingly, by ensuring an adequate line width of the data line and the driving voltage line, color deviation generated between the first red odd-numbered pixel and the first red even-numbered pixel and deterioration of a long range uniformity of the display image may be substantially prevented.

Also, by easily ensuring an adequate width of the first common pixel driver in the row direction, the channel length of the driving transistor formed in the row direction may be comparatively elongated such that the driving range may be increased thereby preventing spots.

The storage capacitor Cst includes a first storage capacitive plate 126 and a second storage capacitive plate 127 formed with a gate insulating layer 140 interposed therebetween. Here, the gate insulating layer 140 is a dielectric material and the storage capacitance of the storage capacitor Cst is determined based on the stored charge and the voltage between both capacitive plates 126 and 127.

The first storage capacitive plate 126 is formed with the same material and in the same layer as the semiconductor layer 131 and the second storage capacitive plate 127 is formed with the same material and in the same layer as the scan line 121, the previous scan line 122, the first light emission control line 1231, the second light emission control line 1232, and the initialization voltage line 124.

Also, the driving voltage line 172 overlapping and passing through the storage capacitor Cst crosses the first light emission control line 1231, the second light emission control line 1232, the scan line 121, the previous scan line 122, and the initialization voltage line 124. A portion of the driving voltage line 172 is connected to the odd-numbered operation control drain electrode 177*e*_T and the even-numbered operation control source electrode 176*e*_B through a contact hole 71, and another portion of the driving voltage line 172 is connected to the semiconductor layer 131 through a contact hole 66.

A connection member 174 is formed to be parallel to the driving voltage line 172 in the same layer. The connection member 174 is connected to the driving gate electrode 125*a* and the first storage capacitive plate 126. One end 174*a* of the connection member 174 is connected to the driving gate electrode 125*a* through a contact hole 67 formed at an interlayer insulating layer 160 and the other end 177*d* of the connection member 174 corresponds to the initialization drain electrode 177*d* of the initialization transistor T4 and is connected to the initialization semiconductor layer 131*d* of the initialization transistor T4 through the contact hole 63. Accordingly, the first storage capacitive plate 126 of the storage capacitor Cst is connected to the initialization semiconductor layer 125*d* through the other end 177*d* of the connection member 174 and is connected to the driving gate electrode 125*a* through one end of the connection member 174.

Accordingly, the storage capacitor Cst stores the storage capacitance corresponding to the difference between the driving voltage ELVDD transmitted through the driving voltage line 172 and the gate voltage of the driving gate electrode 125*a*.

Next, the structure of the OLED display according to an exemplary embodiment will be described according to a deposition sequence thereof with reference to FIG. 7 and FIG. 8.

The structure of the transistor will be described based on the driving transistor T1, the switching transistor T2, the odd-numbered operation control transistor T5_T, the even-numbered operation control transistor T5_B, the odd-numbered light emission control transistor T6_T, and the even-numbered light emission control transistor T6_B. Also, the deposition sequence of the compensation transistor T3 and the initialization transistor T4 is the same as that of the switching transistor T2 and is not described in further detail.

A barrier layer 120 is formed on a substrate 110 and the substrate 110 is a flexible substrate formed of a material such as plastic or polyimide.

The driving semiconductor layer 131*a*, the switching semiconductor layer 131*b*, the odd-numbered operation control semiconductor layer 131*e*_T, the even-numbered operation control semiconductor layer 131*e*_B, the odd-numbered light emission control semiconductor layer 131*f* T, and the even-numbered light emission control semiconductor layer 131*f*_B are formed on the barrier layer 120.

The driving semiconductor layer 131*a* includes a driving source region 176*a* and a driving drain region 177*a* facing each other with a driving channel region 131*a*1 interposed therebetween and the switching semiconductor layer 131*b* includes a switching source region 132*b* and a switching drain region 177*b* facing each other with a switching channel region 131*b*1 interposed therebetween.

Also, the odd-numbered operation control semiconductor layer 131*e*_T includes an odd-numbered operation control channel region 131*e*1_T, an odd-numbered operation control source region 176*e*_T, and an odd-numbered operation control drain region 133*e*_T. The even-numbered operation control semiconductor layer 131*e*_B includes an even-numbered operation control channel region 131*e*1_B, an even-numbered operation control source region 176*e*_B, and an even-numbered operation control drain region 133*e*_B. Further, the odd-numbered light emission control semiconductor layer 131*f*_T includes an odd-numbered light emission control channel region 131*f*1_T, an odd-numbered light emission control source region 176*f*_T, and an odd-numbered light emission control drain region 133*f* T. The even-numbered light emission control semiconductor layer 131*f*_B includes an even-numbered light emission control channel region 131*f*1_B, an even-numbered light emission control source region 176*f*_B, and an even-numbered light emission control drain region 133*f*_B.

The gate insulation layer 140 formed of silicon nitride ($SiN_x$) or silicon dioxide ($SiO_2$) is formed on the driving semiconductor layer 131*a*, the switching semiconductor layer 131*b*, the odd-numbered operation control semiconductor layer 131*e*_T, the even-numbered operation control semiconductor layer 131*e*_B, the odd-numbered light emission control semiconductor layer 131*f* T, and the even-numbered light emission control semiconductor layer 131*f*_B.

The driving gate electrode 125*a*, the scan line 121 including the switching gate electrode 125*b*, the odd-numbered operation control gate electrode 125*e*_T, the first light emission control line 1231 including the odd-numbered light emission control gate electrode 125*f* T, the second light emission control line 1232 including the even-numbered operation control gate electrode 125*e*_B and the even-numbered light emission control gate electrode 125*f* B, and the initialization voltage line 124 are formed on the gate insulating layer 140.

The interlayer insulating layer 160 is formed on the scan line 121, the first light emission control line 1231, the second light emission control line 1232, the initialization voltage line 124, and the gate insulating layer 140. The interlayer insulating layer 160, like the gate insulating layer 140, is formed of a ceramic-based material such as silicon nitride (SiNx) or silicon dioxide (SiO2).

The data line 171 including the switching source electrode 176*b*, the connection member 174 including the initialization drain electrode 177*d*, and the driving voltage line 172 are formed on the interlayer insulating layer 160.

Also, the odd-numbered light emission control drain electrode 177*f*_T is connected to the odd-numbered light emission control drain region 133*f* T of the odd-numbered light emission control semiconductor layer 131*f*_T through a contact hole 72 formed in the gate insulating layer 140 and the interlayer insulating layer 160. The even-numbered light emission control drain electrode 177*f*_B is connected to the even-numbered light emission control drain region 133*f*_B of the even-numbered light emission control semiconductor layer 131*f* B through a contact hole 73.

A protective layer 180 is formed to cover the data line 171, the connection member 174, and the driving voltage line 172 and is also formed on the interlayer insulating layer 160. The first and second pixel electrodes 1911 and 1912 are formed on the protective layer 180. The first pixel electrode 1911 is formed in the first red odd-numbered pixel R1_T and the second pixel electrode 1912 is formed in the first red even-numbered pixel R1_B.

The first and second pixel electrodes 1911 and 1912 are respectively connected to the odd-numbered light emission control drain electrode 177*f*_T and the even-numbered light emission control drain electrode 177*f* B through contact holes 81 and 82 formed in the protective layer 180.

A barrier rib or a pixel defining layer 350 is formed on the edges of the first and second pixel electrodes 1911 and 1912 and the protective layer 180. The barrier rib 350 has a barrier rib opening 351 exposing the first and second pixel electrodes 1911 and 1912. The barrier rib 350 may be formed of a resin such as a polyacrylate, a polyimide, or a silica-based inorganic material.

A first red organic emission layer 371 and a green organic emission layer 372 are respectively formed on the first and second pixel electrodes 1911 exposed by the barrier rib opening 351. A common electrode 270 is formed on the first red and green organic emission layers 371 and 372. As described above, the first OLED 700_T includes the first pixel electrode 1911, the first red organic emission layer 371, and the common electrode 270. Similarly, the second OLED 700_B includes the second pixel electrode 1912, the green organic emission layer 372, and the common electrode 270.

Here, the first and second pixel electrodes 1911 and 1912 are anodes which function as hole injection electrodes and the common electrode 270 is a cathode which functions as an electron injection electrode. However, the described technology is not limited thereto. In some embodiments, the first and second pixel electrodes 1911 and 1912 may be the cathodes and the common electrode 270 may be the anode.

The first red and green organic emission layers 371 and 372 are formed of a low molecular weight organic material or a high molecular weight organic material such as PEDOT (poly(3,4-ethylenedioxythiophene)). Also, the first red and green organic emission layers 371 and 372 may be formed to include a multilayer including an emission layer and one or more of a hole injection layer (HIL), a hole transport layer (HTL), an electron transport layer (ETL), and an electron injection layer (EIL). When all the layers are included, the hole injection layer (HIL) is disposed on the pixel electrode 191 functioning as the anode, and the hole transport layer (HTL), the emission layer, the electron transport layer (ETL), and the electron injection layer (EIL) are sequentially laminated thereon.

A sealing member (not illustrated) which protects the first and second OLEDs 700_T and 700_B may be formed on the common electrode 270, may be sealed by a sealant on the substrate 110, and may be formed of various materials such as glass, quartz, ceramic, plastics, or metal. Meanwhile, a sealing thin film layer may be formed by depositing an inorganic layer and an organic layer on the common electrode 270 while not using the sealant.

In other embodiments, the initialization voltage line is shared by the adjacent pixel units.

Next, another exemplary embodiment will be described with reference to FIG. 9 and FIG. 10.

Figure 9:
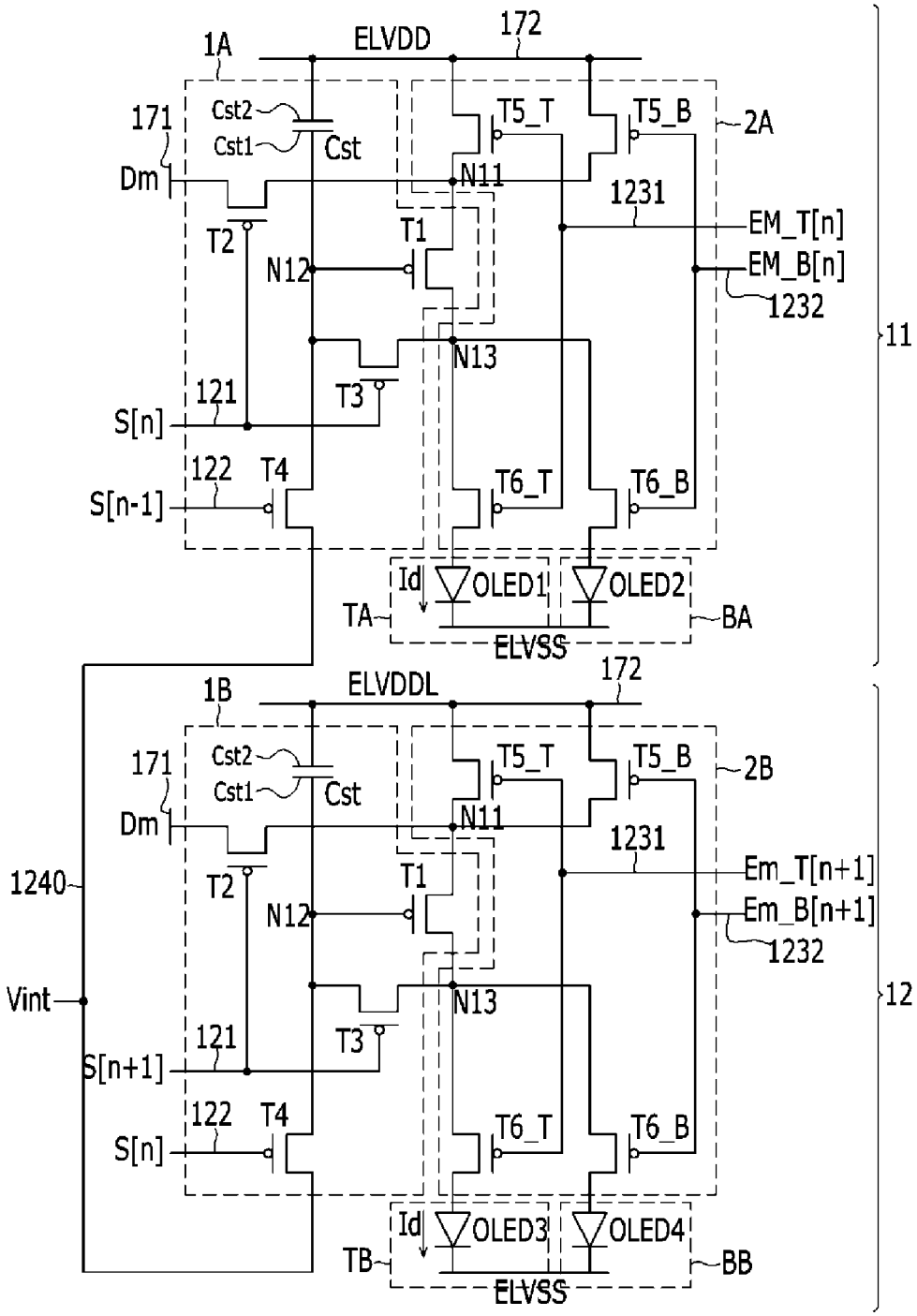
FIG. 9 is an equivalent circuit of a first pixel unit and a second pixel unit adjacent in a column direction of an OLED display according to another exemplary embodiment.

FIG. 9 is an equivalent circuit of a first pixel unit and a second pixel unit adjacent in a column direction of an OLED display according to another exemplary embodiment. FIG. 10 is a layout view of the OLED display of the embodiment of FIG. 9.

Figure 10:
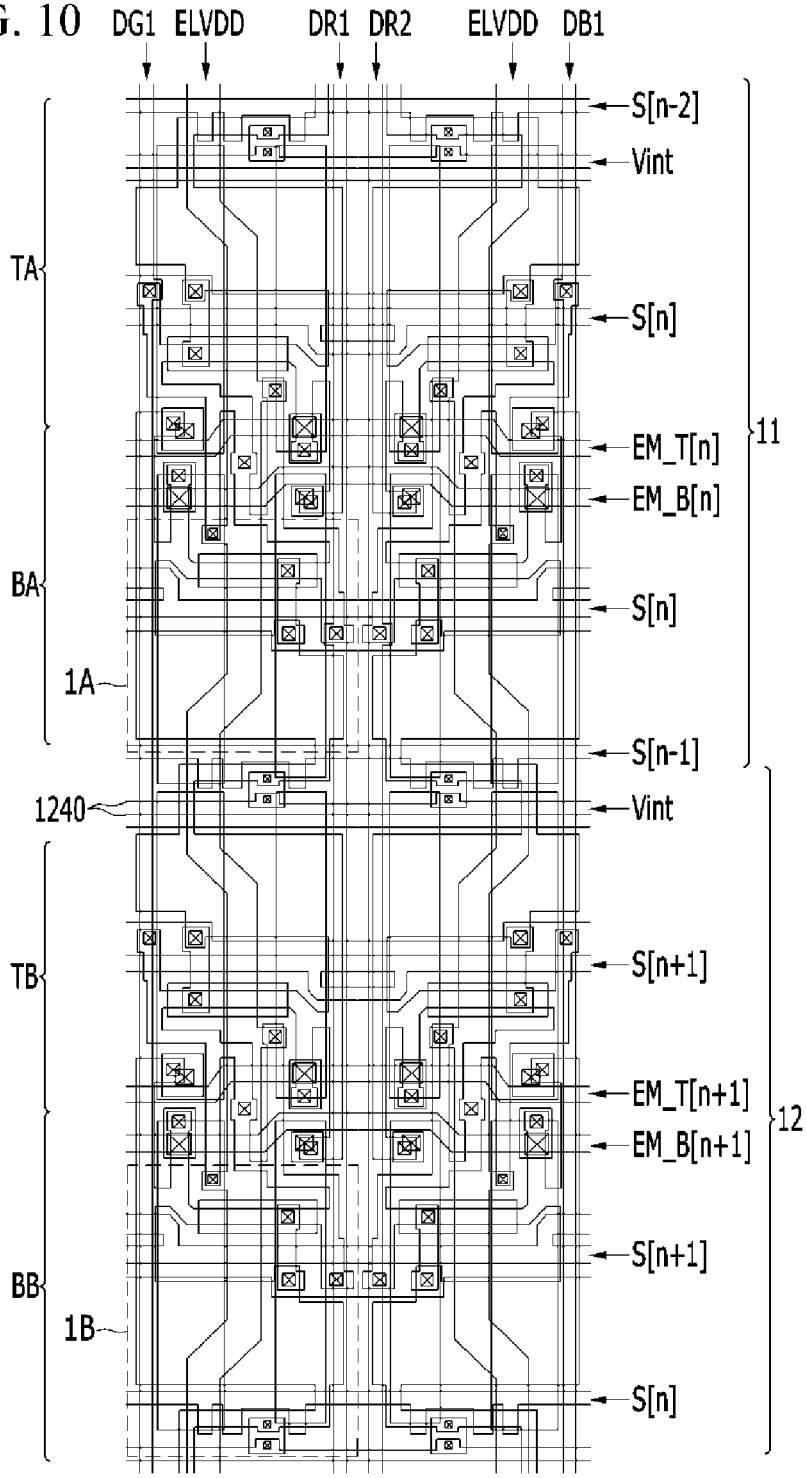
FIG. 10 is a layout view of an OLED display according to another exemplary embodiment.

The embodiment shown in FIG. 9 and FIG. 10 is substantially equivalent to the embodiment shown in FIG. 1 to FIG. 8 except for a common initialization voltage line, thus descriptions of the same elements will be omitted.

Firstly, as shown in FIG. 9, the OLED display includes a first pixel unit 11 and a second pixel unit 12 formed to be adjacent in the column direction. The first pixel unit 11 includes a first odd-numbered pixel TA, a first even-numbered pixel BA, a first common pixel driver 1A, and a first selection unit 2A. The second pixel unit 12 includes a second odd-numbered pixel TB, a second even-numbered pixel BB, a second common pixel driver 1B, and a second selection unit 2B.

The first odd-numbered pixel TA is formed at the first odd-numbered row, the first even-numbered pixel BA is formed at the first even-numbered row, the second odd-numbered pixel TB is formed at the second odd-numbered row, and the second even-numbered pixel BB is formed at the second even-numbered row.

The first common pixel driver 1A is connected to the first odd-numbered pixel TA and the first even-numbered pixel BA and is activated according to the (n−1)-th scan signal S[n−1] and the n-th scan signal S[n]. The second common pixel driver 1B is commonly connected to the second odd-numbered pixel TB and the second even-numbered pixel BB and is activated according to the n-th scan signal S[n] and the (n+1)-th scan signal S[n+1].

The first selection unit 2A applies the driving current (Id) to one of the first and second OLEDs OLED1 and OLED2 according to the first and second light emission control signals EM_T[n] and EM_B[n]. Further, the second selection unit 2B applies the driving current (Id) to one of the third and fourth OLEDs OLED3 and OLED4 according to the third light emission control signal EM_T[n+1] and the fourth light emission control signal EM_B[n+1].

Accordingly, one of the first odd or even-numbered pixels emits light in the corresponding OLED, OLED1 or OLED2, based on the control of the first selection unit 2A. Similarly, one of the second odd or even-numbered pixels emits light in the corresponding OLED, OLED3 or OLED4, based on the control of the second selection unit 2B.

Also, a common initialization voltage line 1240 is formed connected to both the first pixel unit and the second pixel unit and applies the initialization voltage Vint thereto.

As shown in FIG. 10, the first common pixel driver 1A is formed to be substantially as wide as the first even-numbered row. Similarly, the second common pixel driver 1B is formed to be substantially as wide as the second even-numbered row such that the width of each of the first and second common pixel drivers 1A and 1B is maximized.

The common initialization voltage line 1240 is disposed between the first pixel unit 11 and the second pixel unit 12.

As described above, by forming the common initialization voltage line 1240 which commonly applies the initialization voltage to the first and second pixel units formed to be adjacent to each other in the column direction, a layout margin can be provided in the column direction.

In other embodiments, the odd-numbered operation control transistor T5_T and the even-numbered operation control transistor T5_B are formed as a single operation control transistor T5.

This configuration will be described in detail with reference to FIG. 11 to FIG. 16.

Figure 11:
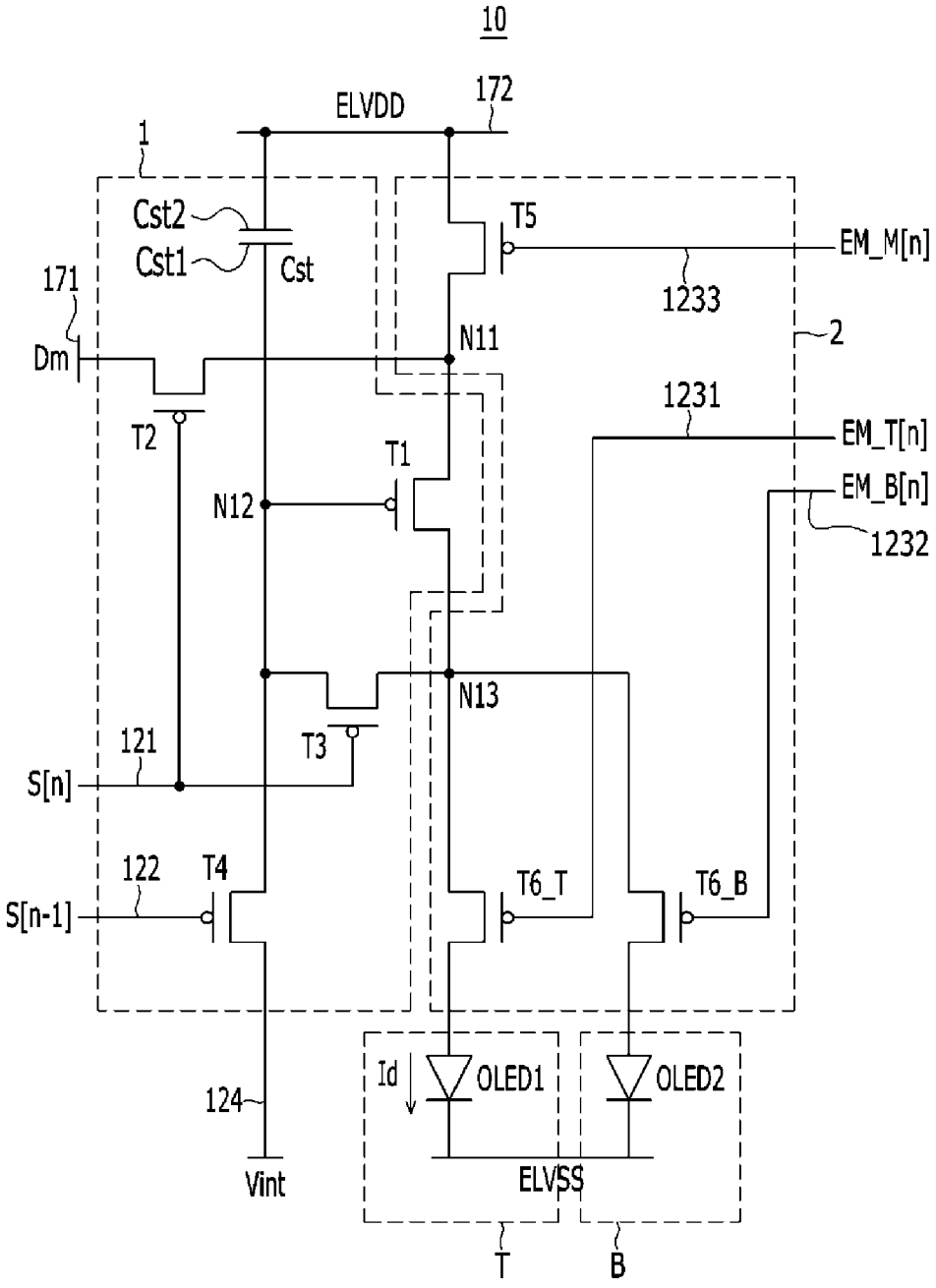
FIG. 11 is an equivalent circuit diagram of a pixel unit of an OLED display according to another exemplary embodiment.
Figure 12:
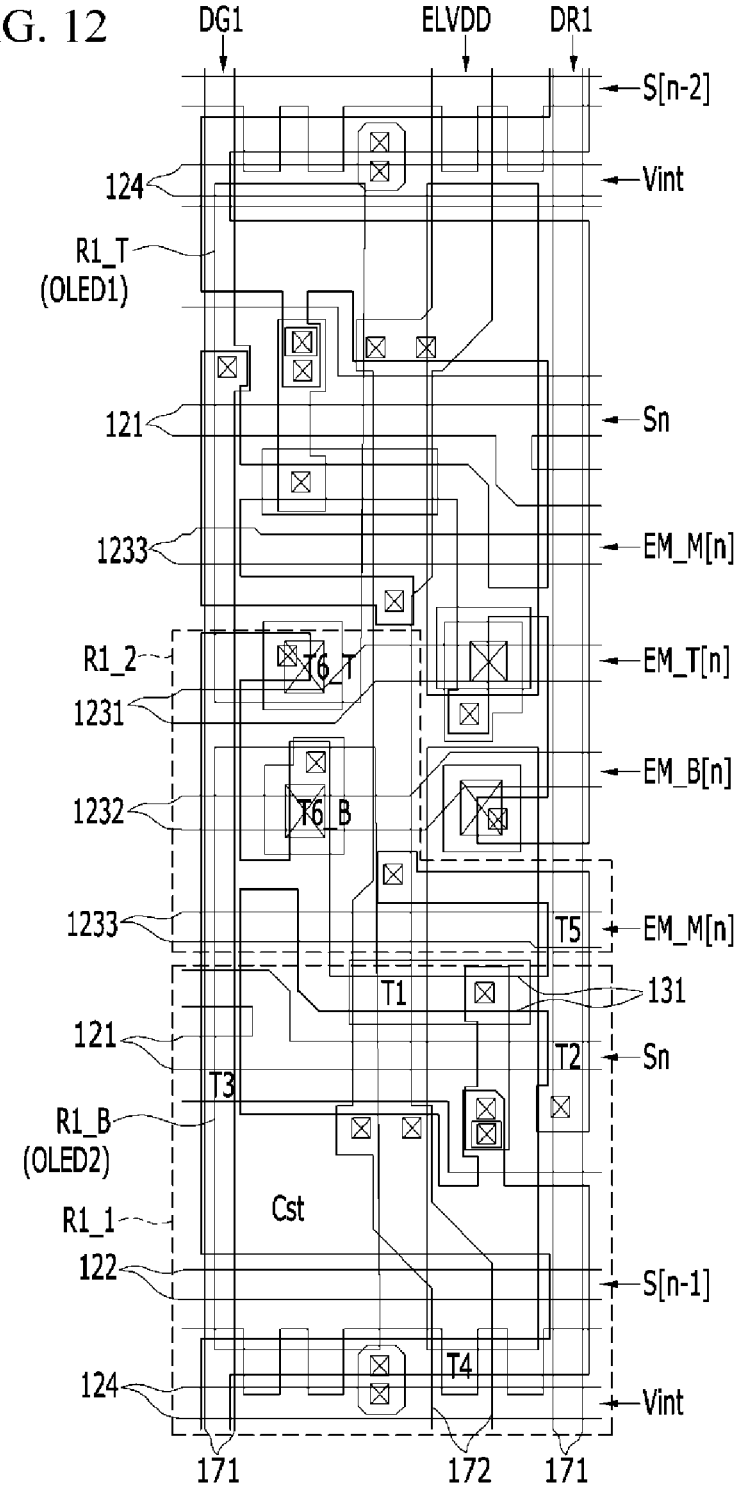
FIG. 12 is a view of a plurality of transistors and capacitors formed in a first red odd-numbered pixel, a first red even-numbered pixel, and a first red common pixel driver and a first red selection unit connected thereto, and a green odd-numbered pixel, a green even-numbered pixel, and a green common pixel driver and a green selection unit connected thereto of an OLED display according to another exemplary embodiment.
Figure 13:
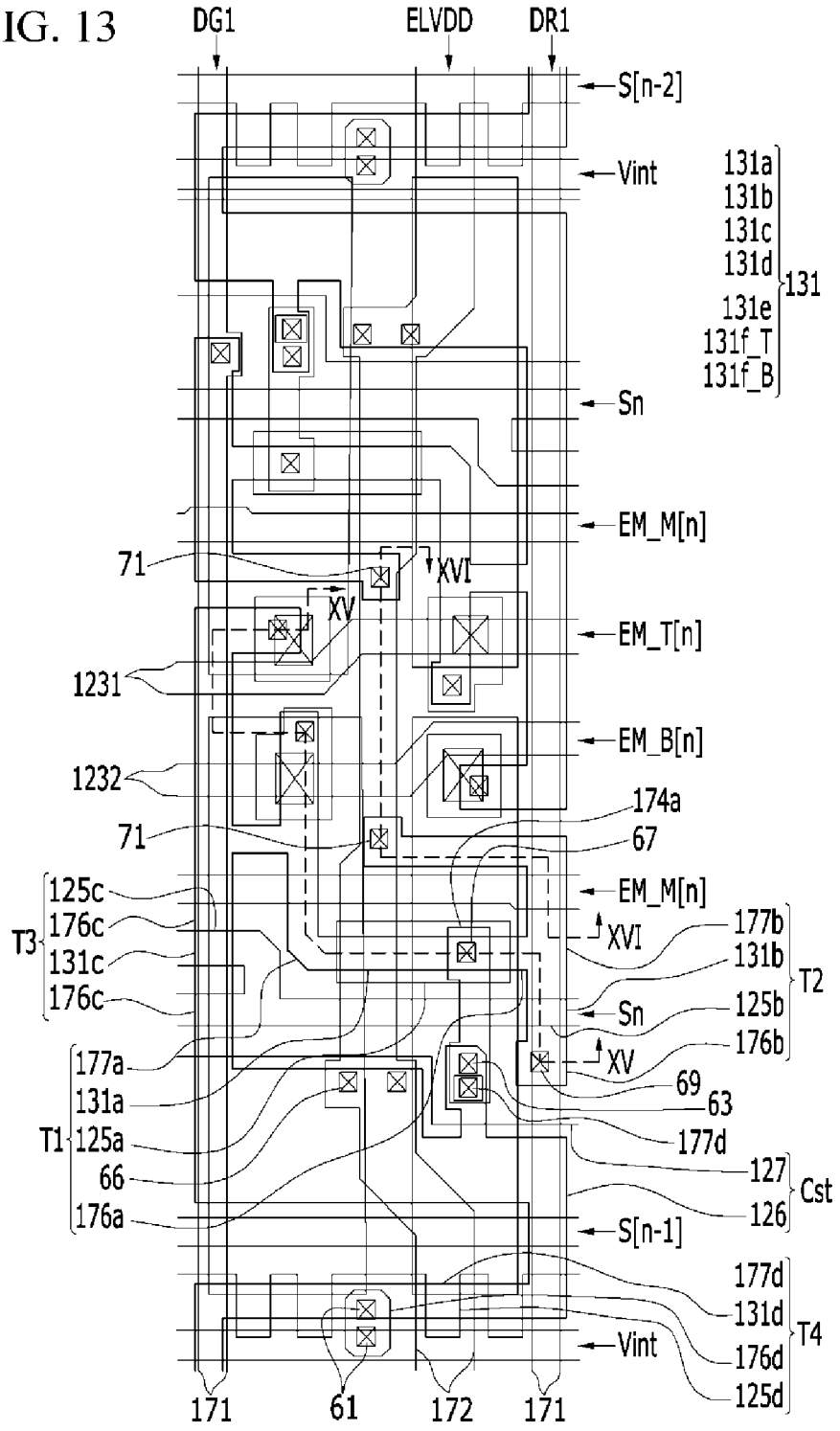
FIG. 13 is a detailed layout view of FIG. 12.
Figure 14:
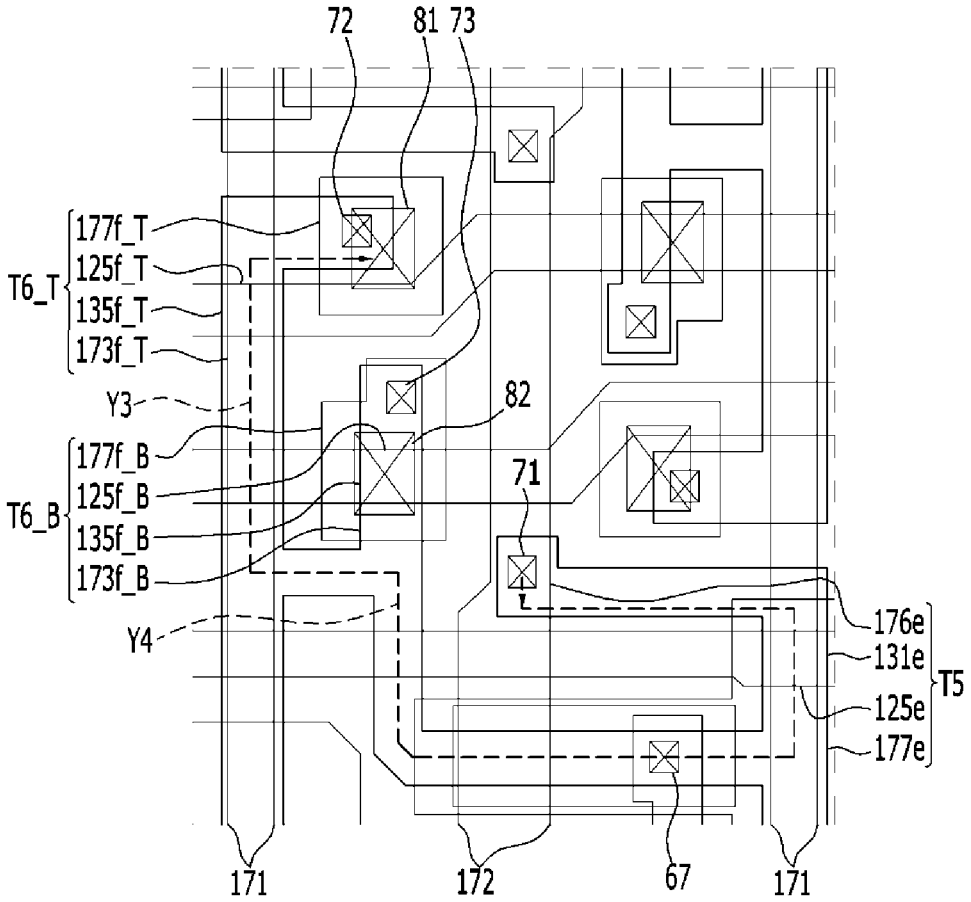
FIG. 14 is an enlarged layout view of the first red selection unit and the green selection unit shown in FIG. 13.
Figure 15:
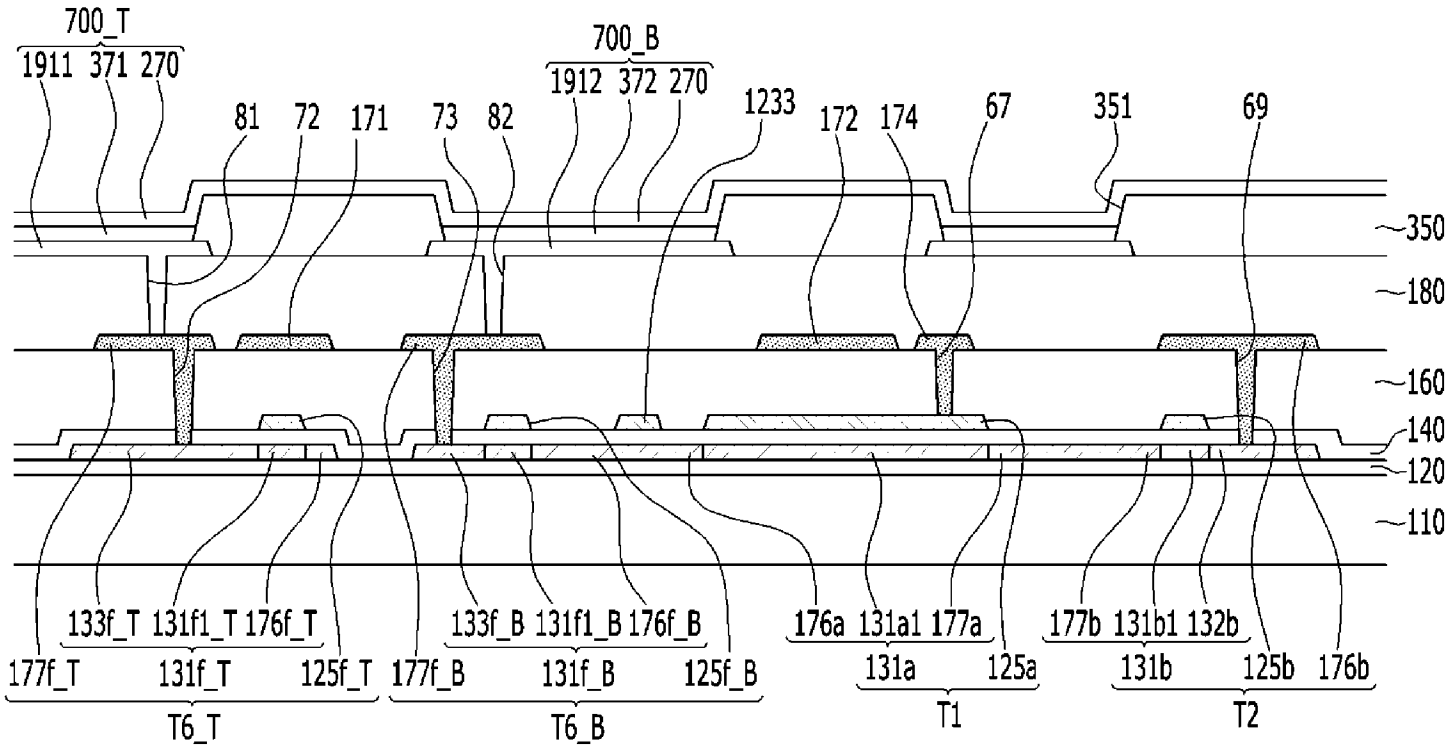
FIG. 15 is a cross-sectional view taken along the line XV-XV of FIG. 13.
Figure 16:
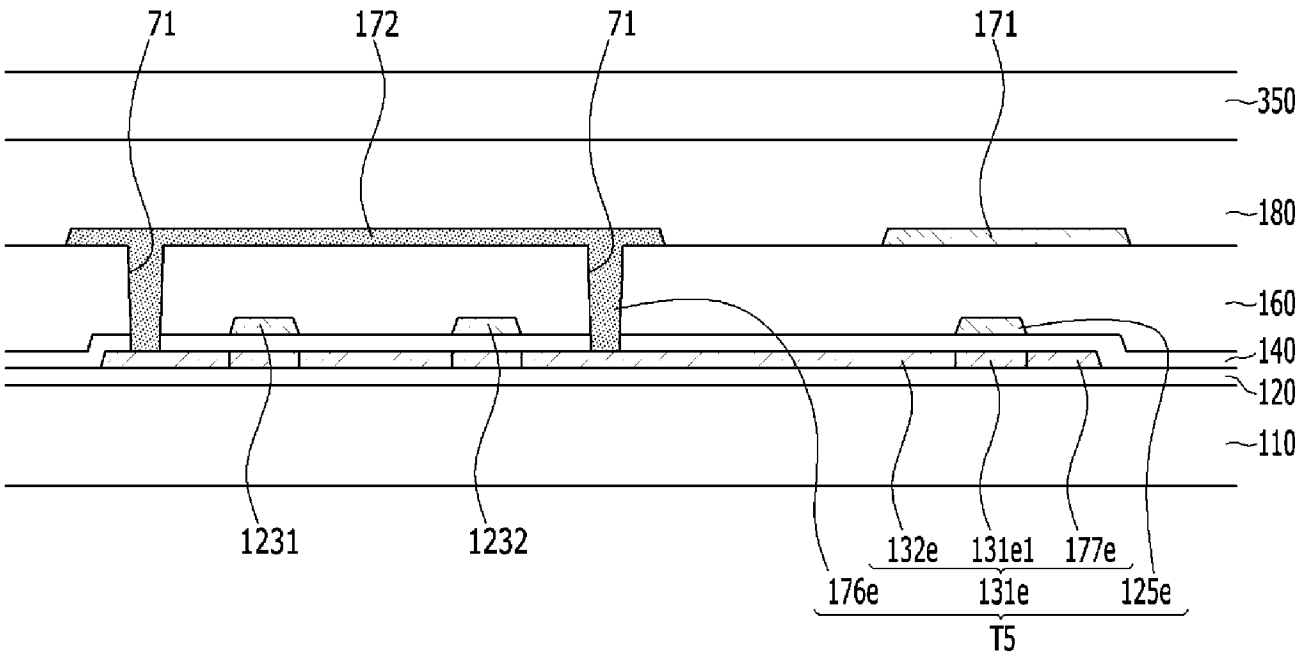
FIG. 16 is a cross-sectional view taken along the line XVI-XVI of FIG. 13.

FIG. 11 is an equivalent circuit diagram of a pixel unit of an OLED display according to another exemplary embodiment. FIG. 12 is a view of a plurality of transistors and capacitors formed in a first red odd-numbered pixel, a first red even-numbered pixel, and a first red common pixel driver and a first red selection unit connected thereto, and a green odd-numbered pixel, a green even-numbered pixel, and a green common pixel driver and a green selection unit connected thereto included in an OLED display according to an exemplary embodiment. FIG. 13 is a detailed layout view of FIG. 12. FIG. 14 is an enlarged layout view of the first red selection unit and the green selection unit shown in FIG. 13. FIG. 15 is a cross-sectional view taken along the line XV-XV of FIG. 13. FIG. 16 is a cross-sectional view taken along the line XVI-XVI of FIG. 13.

The embodiment shown in FIG. 11 to FIG. 16 is substantially the same as the embodiment shown in FIG. 1 to FIG. 8 except for the operation control transistor T5, thus descriptions of the same elements will be omitted.

Firstly, as shown in FIG. 11, the OLED display includes a pixel unit 10 including an odd-numbered pixel T, an even-numbered pixel B, a common pixel driver 1, and a selection unit 2.

The selection unit 2 applies the driving current (Id) to one of the first and second OLEDs, OLED1 and OLED2, according to the first light emission control signal EM_T[n], the second light emission control signal EM_B[n], and the third light emission control signal EM_M[n]. The selection unit 2 includes an operation control transistor T5, an odd-numbered light emission control transistor T6_T, and an even-numbered light emission control transistor T6_B.

The operation control transistor T5_T includes the source electrode connected to the driving voltage line 172, the drain electrode connected to the first node N11, and the gate electrode connected to the third light emission control line 1233.

The odd-numbered light emission control transistor T6_T includes a source electrode connected to the third node N13, a drain electrode connected to the anode of the first organic light emitting diode OLED1, and a gate electrode connected to the first light emission control line 1231. The even-numbered light emission control transistor T6_B includes a source electrode connected to the third node N13, a drain electrode connected to the anode of the second OLED OLED2, and a gate electrode connected to the second light emission control line 1232.

The schematic structure of the OLED display shown in FIG. 11 is the same as that of FIG. 3 and the description thereof is the same.

The detailed structure of the OLED display shown in FIG. 11 will be described with reference to FIG. 12 to FIG. 16. Here, the first red odd-numbered pixel R1_T, the first red even-numbered pixel R1_B and the first red common pixel driver R1_1 and the first red selection unit R1_2 connected thereto will be described.

As shown in FIG. 12, the OLED display includes the scan line 121, the previous scan line 122, the first light emission control line 1231, the second light emission control line 1232, the third light emission control line 1233, and the initialization voltage line 124. These signal lines respectively apply the scan signal Sn, the previous scan signal S[n−1], the first light emission control signal EM_T[n], the second light emission control signal EM_B[n], the third light emission control signal EM_M[n], and the initialization voltage Vint and formed in the row direction. The data line 171 and the driving voltage line 172 are formed intersecting each of the scan line 121, the previous scan line 122, the first light emission control line 1231, the second light emission control line 1232, the third light emission control line 1233, and the initialization voltage line 124. The data line 17 and the driving voltage line 172 and respectively apply the data signals DR1 and DG1 and the driving voltage ELVDD.

Also, the OLED display includes the driving transistor T1, the switching transistor T2, the compensation transistor T3, the initialization transistor T4, the operation control transistor T5, the odd-numbered light emission control transistor T6_T, the even-numbered light emission control transistor T6_B, the storage capacitor Cst, the first and second OLEDs, OLED1 and OLED2. In FIG. 12, for convenience of explanation, the first red odd-numbered pixel R1_T corresponds to the first OLED (OLED1) and the first red even-numbered pixel R1_B corresponds to the second OLED (OLED2).

Hereinafter, the planar structure of the OLED display will first be described in detail with reference to FIG. 12 to FIG. 14. The lamination structure thereof will be described in detail with reference to FIG. 15 and FIG. 16.

Firstly, as shown in FIG. 12 to FIG. 14, the semiconductor layer 131 of the OLED display includes the driving semiconductor layer 131*a* formed in the driving transistor T1, the switching semiconductor layer 131*b* formed in the switching transistor T2, the compensation semiconductor layer 131*c* formed in the compensation transistor T3, the initialization semiconductor layer 131*d* formed in the initialization transistor T4, the operation control semiconductor layer 131*e* formed in the operation control transistor T5, and the odd and even-numbered light emission control semiconductor layers 131*f*_T and 131*f*_B respectively formed in the odd and even-numbered light emission control transistors T6_T and T6_B.

The first red common pixel driver R1_1 includes the driving transistor T1, the switching transistor T2, the compensation transistor T3, and the initialization transistor T4. The first red selection unit R1_2 includes the operation control transistor T5 and the odd and even-numbered light emission control transistors T6_T and T6_B.

The driving transistor T1 includes the driving semiconductor layer 131*a*, the driving gate electrode 125*a*, the driving source electrode 176*a*, and the driving drain electrode 177*a*. The driving source electrode 176*a* corresponds to the driving source region 176*a* doped with an impurity in the driving semiconductor layer 131*a*, and the driving drain electrode 177*a* corresponds to the driving drain region 177*a* doped with an impurity in the driving semiconductor layer 131*a*.

The switching transistor T2 includes the switching semiconductor layer 131*b*, the switching gate electrode 125*b*, the switching source electrode 176*b*, and the switching drain electrode 177*b*. The switching source electrode 176*b* is a portion of the data line 171, and the switching drain electrode 177*b* corresponds to the switching drain region 177*b* doped with an impurity in the switching semiconductor layer 131*b*.

The compensation transistor T3 includes the compensation semiconductor layer 131*c*, the compensation gate electrode 125*c*, the compensation source electrode 176*c*, and the compensation drain electrode 177*c*. The compensation source electrode 176*c* corresponds to the compensation source region 176*c* doped with an impurity in the compensation semiconductor layer 131*c*, while the compensation drain electrode 177*c* is the compensation drain region 177*c* doped with an impurity in the compensation semiconductor layer 131*c*.

The initialization transistor T4 includes the initialization semiconductor layer 131*d*, the initialization gate electrode 125*d*, the initialization source electrode 176*d*, and the initialization drain electrode 177*d*. The initialization source electrode 176*d* is connected to both the initialization voltage line 124 and the initialization semiconductor layer 131*d* through the contact hole 61. The initialization drain electrode 177*d* as the other end of the connecting member 174 is connected to the initialization semiconductor layer 131*d* through the contact hole 63.

The operation control transistor T5 includes the operation control semiconductor layer 131*e*, the operation control gate electrode 125*e*, the operation control source electrode 176*e*, and the operation control drain electrode 177*e*.

The odd-numbered light emission control transistor T6_T includes the odd-numbered light emission control semiconductor layer 131*f*_T, the odd-numbered light emission control gate electrode 125*f*_T, the odd-numbered light emission control source electrode 176*f*_T, and the odd-numbered light emission control drain electrode 177*f* T. The even-numbered light emission control transistor T6_B includes the even-numbered light emission control semiconductor layer 131*f*_B, the even-numbered light emission control gate electrode 125*f*_B, the even-numbered light emission control source electrode 176*f* B, and the even-numbered light emission control drain electrode 177*f* B.

The operation control transistor T5 is operated according to the third light emission control signal EM_M[n] such that the driving voltage ELVDD is transmitted to the driving transistor T1.

Also, the odd-numbered light emission control transistor T6_T is operated according to the first light emission control signal EM_T[n] such that the first OLED 700_T including the first pixel electrode 1911 emits light. The even-numbered light emission control transistor T6_B is operated according to the second light emission control signal EM_B[n] such that the second OLED 700_B including the second pixel electrode 1912 emits light. In FIG. 14, Y3 represents a path through which current flows to control the first OLED 700_T to emit light based on the first light emission control signal EM_T[n] and Y4 represents a path through which current flows to control the second OLED 700_B to emit light based on the second light emission control signal EM_B[n].

As described above, by forming the odd-numbered operation control transistor T5_T and the even-numbered operation control transistor T5_B as a single operation control transistor T5, a margin may be added to the channel length in the row direction in the operation control semiconductor layer, and thus, a high resolution may be realized.

The first storage capacitor plate 126 is formed of the same material and in the same layer as the semiconductor layer 131 and the second storage capacitor plate 127 is formed of the same material and in the same layer as the scan line 121, the previous scan line 122, the first light emission control line 1231, the second light emission control line 1232, the third light emission control line 1233, and the initialization voltage line 124.

Also, the driving voltage line 172 is formed to overlap and intersect the storage capacitor Cst and to intersect the first light emission control line 1231, the second light emission control line 1232, the third light emission control line 1233, the scan line 121, the previous scan line 122, and the initialization voltage line 124. A portion of the driving voltage line 172 is connected to the operation control source electrode 176*e* through the contact hole 71 and the other portion of the driving voltage line 172 is connected to the semiconductor layer 131 through the contact hole 66.

The connection member 174 is formed parallel to and in the same layer as the driving voltage line 172. The connection member 174 connects the driving gate electrode 125*a* and the first storage capacitor plate 132. One end 174*a* of the connection member 174 is connected to the driving gate electrode 125*a* through the contact hole 67 formed in the interlayer insulating layer 160 and the other end 177*d* of the connection member 174 corresponds to the initialization drain electrode 177*d* of the initialization transistor T4 and is connected to the initialization semiconductor layer 131*d* of the initialization transistor T4 through the contact hole 63. Accordingly, the first storage capacitor plate 126 of the storage capacitor Cst is connected to the initialization semiconductor layer 125*d* through the other end 177*d* of the connecting member 174 and is connected to the driving gate electrode 125*a* through one end of the connecting member 174.

Accordingly, the storage capacitor Cst stores the storage capacitance corresponding to the difference between the driving voltage ELVDD transmitted through the driving voltage line 172 and the gate voltage of the driving gate electrode 125*a*.

While the described technology has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An organic light-emitting diode (OLED) display, comprising:

a substrate;

a plurality of pixels formed over the substrate and arranged in rows and columns, wherein the pixels comprise a plurality of odd-numbered pixels and a plurality of even-numbered pixel formed to be adjacent to each other in a column direction and wherein the odd-numbered pixels are formed in odd-numbered rows and the even-numbered pixels are formed in even-numbered rows;

a common pixel driver connected to an odd-numbered pixel and an even-numbered pixel, wherein the common pixel driver is configured to alternately drive the odd-numbered pixel and the even-numbered pixel; and a selector configured to select one of the odd-numbered pixel and the even-numbered pixel to be driven by the common pixel driver, wherein the common pixel driver is formed in either the odd-numbered row or the even-numbered row, and wherein the common pixel driver overlaps the pixels of either the odd-numbered row or the even-numbered row.

2. The OLED display of claim 1, further comprising:

a scan line and a previous scan line respectively configured to apply a scan signal and a previous scan signal;

a data line and a driving voltage line crossing each of the scan line and the previous scan line, wherein the data line and the driving voltage line are respectively configured to apply a data signal and a driving voltage;

a first light emission control line and a second light emission control line respectively configured to apply a first light emission control signal and a second light emission control signal; and a first OLED and a second OLED respectively formed in the odd-numbered pixels and the even-numbered pixels, wherein the selector is configured to control one of the odd-numbered pixel and the even-numbered pixel to be driven by the common pixel driver based at least in part on one of the first light emission control signal or the second light emission control signal.

3. The OLED display of claim 2, wherein the common pixel driver comprises:

a switching transistor connected to the scan line and the data line, wherein the switching transistor comprises a switching drain electrode;

a driving transistor connected to the switching drain electrode; and a compensation transistor connected to the driving transistor and configured to compensate for a threshold voltage of the driving transistor.

4. The OLED display of claim 3, wherein the selector comprises:

an odd-numbered operation control transistor and an even-numbered operation control transistor respectively configured to apply the driving voltage to the driving transistor based at least in part on the first and second light emission control signals, respectively; and an odd-numbered light emission control transistor and an even-numbered light emission control transistor respectively configured to selectively apply the driving voltage to the first and second OLEDs based at least in part on the first and second light emission control signals, respectively.

5. The OLED display of claim 4, wherein the odd-numbered light emission control transistor is formed between and electrically connected to the driving transistor and the first OLED and wherein the even-numbered light emission control transistor is formed between and electrically connected to the driving transistor and the second OLED.

6. The OLED display of claim 4, wherein each of the odd-numbered operation control transistor and the even-numbered operation control transistor is formed between and electrically connected to the driving voltage line and the driving transistor.

7. The OLED display of claim 4, further comprising an initialization voltage line configured to apply an initialization voltage, wherein the common pixel driver further comprises an initialization transistor configured to apply the initialization voltage to the driving transistor based at least in part on the previous scan signal, wherein the initialization transistor is formed between and electrically connected to the initialization voltage line and the driving transistor.

8. The OLED display of claim 3, further comprising a third light emission control line configured to apply a third light emission control signal, wherein the selector comprises:

an operation control transistor configured to apply the driving voltage to the driving transistor based at least in part on the third light emission control signal; and an odd-numbered light emission control transistor and an even-numbered light emission control transistor respectively configured to apply the driving voltage to the first and second OLEDs based at least in part on the first and second light emission control signals, respectively.

9. The OLED display of claim 8, wherein the odd-numbered light emission control transistor is formed between and electrically connected to the driving transistor and the first OLED and wherein the even-numbered light emission control transistor is formed between and electrically connected to the driving transistor and the second OLED.

10. The OLED display of claim 8, wherein the operation control transistor is formed between and electrically connected to the driving voltage line and the driving transistor.

11. The OLED display of claim 8, further comprising an initialization voltage line configured to apply an initialization voltage, wherein the common pixel driver further comprises an initialization transistor configured to apply the initialization voltage to the driving transistor based at least in part on the previous scan signal, wherein the initialization transistor is formed between the initialization voltage line and the driving transistor.

12. An organic light-emitting diode (OLED) display, comprising:

a plurality of pixel dots arranged in rows and columns; and a common pixel driver, wherein each pixel dot comprises:

a first color pixel including i) a first color odd-numbered pixel and ii) a first color even-numbered pixel formed to be adjacent to each other in a column direction;

a second color pixel including a second color odd-numbered pixel and a second color even-numbered pixel; and a third color pixel including a third color odd-numbered pixel and a third color even-numbered pixel, wherein each of the odd-numbered pixels is formed in an odd-numbered row and each of the even-numbered pixels is formed in an even-numbered row;

wherein the common pixel driver is configured to drive the odd and even-numbered pixels of one of the first to third color pixels, and wherein the common pixel driver is formed adjacent to the one of the color pixels and a color pixel neighboring the one of the color pixels, and wherein the common pixel driver overlaps the pixels of either the odd-numbered row or the even-numbered row.

13. The OLED display of claim 12, wherein the common pixel driver further comprises a first color common pixel driver, wherein the first color common pixel driver is configured to drive the odd and even-numbered pixels of the first color pixel, and wherein the first color common pixel driver is formed adjacent to the first color even-numbered pixel and ii) a position corresponding to a color pixel neighboring the first color even-numbered pixel.

14. The OLED display of claim 13, wherein the common pixel driver further comprises a second color common pixel driver, wherein the second color common pixel driver is configured to drive the odd and even-numbered pixels of the second color pixel, and wherein the second color common pixel driver is formed adjacent to the second color odd-numbered pixel and a color pixel neighboring the second color odd-numbered pixel.

15. The OLED display of claim 14, wherein the common pixel driver further comprises a third color common pixel driver, wherein the third color common pixel driver is configured to drive the odd and even-numbered pixels of the third color pixel, and wherein the third color common pixel driver is formed adjacent to the third color odd-numbered pixel and a color pixel neighboring the third color odd-numbered pixel.

16. An organic light-emitting diode (OLED) display, comprising:

a substrate;

a plurality of pixels formed over the substrate and arranged in rows and columns, wherein the pixels comprise:

a first pixel unit including a first odd-numbered pixel and a first even-numbered pixel respectively formed in a first odd-numbered row and a first even-numbered row; and a second pixel unit including a second odd-numbered pixel and a second even-numbered pixel respectively formed in a second odd-numbered row and a second even-numbered row;

a first common pixel driver electrically connected to the first odd-numbered pixel and the first even-numbered pixel, wherein the first common pixel driver is configured to drive the first odd-numbered pixel and the first even-numbered pixel, and a first selector configured to select one of the first odd-numbered pixel and the first even-numbered pixel to be driven by the first common pixel driver;

a second common pixel driver electrically connected to the second odd-numbered pixel and the second even-numbered pixel, wherein the second common pixel driver is configured to drive the second odd-numbered pixel and the second even-numbered pixel; and a second selector configured to select one of the second odd-numbered pixel and the second even-numbered pixel to be driven by the second common pixel driver; and a common initialization voltage line formed between the first and second pixel units and respectively electrically connected to the first and second pixel units, wherein the common initialization voltage line is configured to apply an initialization voltage to the first and second pixel units, wherein the first common pixel driver is formed in one of the first odd and even-numbered rows, wherein the second common pixel driver is formed in one of the second odd and even-numbered rows, wherein the first common pixel driver overlaps the pixels of either the first odd-numbered row or the first even-numbered row, and wherein the second common pixel driver overlaps the pixels of either the second odd-numbered row or the second even-numbered row.

17. An organic light-emitting diode (OLED) display, comprising:

a plurality of pixels arranged in rows and columns, wherein the pixels comprise:

a plurality of first pixels formed in odd-numbered rows; and a plurality of second pixels formed in even-numbered row and adjacent to the first pixels in a column direction; and a common pixel driver connected to the first and second pixels, wherein the common pixel driver is configured to alternately drive the first and second pixels, wherein the common pixel driver is formed in a position substantially directly below one of the first and second pixels.

18. The OLED display of claim 17, further comprising a selector configured to select one of the first and second pixels to be driven by the common pixel driver.

19. The OLED display of claim 18, further comprising first and second light emission control lines respectively configured to apply first and second light emission control signals, wherein the selector is further configured to control one of the first and second pixels to be driven by the common pixel driver based at least in part on one of the first and second light emission control signals.

20. The OLED display of claim 17, wherein the common pixel driver is formed in one of the odd and even-numbered rows.

* * * * *